US009944360B2

(12) United States Patent
Franklin

(10) Patent No.: US 9,944,360 B2
(45) Date of Patent: Apr. 17, 2018

(54) SWIM LIFT

(71) Applicant: Michael Franklin, Carrollton, TX (US)

(72) Inventor: Michael Franklin, Carrollton, TX (US)

( * ) Notice: Subject to any disclaimer, the term of this patent is extended or adjusted under 35 U.S.C. 154(b) by 0 days.

(21) Appl. No.: 15/683,054

(22) Filed: Aug. 22, 2017

(65) Prior Publication Data

US 2018/0057118 A1 Mar. 1, 2018

Related U.S. Application Data

(60) Provisional application No. 62/378,456, filed on Aug. 23, 2016.

(51) Int. Cl.

| | |
|---|---|
| ***B63B 27/16*** | (2006.01) |
| ***B63B 27/36*** | (2006.01) |
| ***B63B 17/00*** | (2006.01) |
| *B63B 29/02* | (2006.01) |

(52) U.S. Cl.
CPC ..... *B63B 27/16* (2013.01); *B63B 17/00* (2013.01); *B63B 27/36* (2013.01); *B63B 2029/022* (2013.01)

(58) Field of Classification Search
CPC ..... B63B 27/16; B63B 27/36
USPC ..... 114/362
See application file for complete search history.

(56) References Cited

U.S. PATENT DOCUMENTS 5,367,721 A 11/1994 Boyles
5,385,112 A 1/1995 Dorris
5,572,921 A 11/1996 Krumbeck
5,685,030 A 11/1997 Baranowski
5,735,561 A 4/1998 Parkins
6,003,463 A * 12/1999 Giesler ..... B63B 23/32 114/259
6,047,659 A 4/2000 Schmidt
6,093,070 A 7/2000 Mannes
6,309,160 B1 10/2001 Greene
6,431,105 B2 8/2002 Haram
6,591,770 B1 * 7/2003 Blackmore ..... B63B 27/36 114/259
6,698,371 B1 * 3/2004 Stoltzfus ..... B63B 35/58 114/61.1
6,789,648 B2 9/2004 Cook
6,793,039 B2 9/2004 Schmid
6,938,572 B1 9/2005 Besecker et al.
7,618,223 B1 11/2009 Begley
(Continued)

*Primary Examiner* — S. Joseph Morano
*Assistant Examiner* — Jovon Hayes

(57) ABSTRACT

Disclosed herein is an apparatus with a remotely controlled hydraulically actuated platform, upon which a swimmer may stand in order to be raised out of the water or lower into the water. One version comprises a scissor mechanism assembly bolted underneath the swim deck of a boat, a hydraulic cylinder that extends the scissor mechanism, a retracting stand platform attached to the scissor mechanism that can slide inward and under the deck of the boat for storage, a hydraulic power unit, and a wireless remote control. The most preferred embodiment comprises a hydraulic cylinder that extends above the swim deck of a boat, an anchor assembly that is bolted underneath the swim deck of the boat, a stand platform with a handle, a hydraulic power unit, and a wireless remote control that operates the hydraulic unit and lifts a single swimmer into and out of the water.

5 Claims, 39 Drawing Sheets

(56) References Cited

U.S. PATENT DOCUMENTS

| | | | | |
|---|---|---|---|---|
| 7,946,243 | B1 * | 5/2011 | Ulrich | B63B 27/16 114/362 |
| 8,172,630 | B2 | 5/2012 | Wright | |
| 8,833,290 | B2 * | 9/2014 | Mueller | B63B 27/14 114/343 |
| 2003/0176123 | A1 | 9/2003 | Schwindt | |
| 2004/0144296 | A1 * | 7/2004 | Houlder | B63B 27/14 114/343 |
| 2009/0072067 | A1 | 3/2009 | Lien | |
| 2009/0197490 | A1 | 8/2009 | Quackenbush et al. | |
| 2011/0023770 | A1 * | 2/2011 | Brown | B63B 27/143 114/362 |
| 2012/0141233 | A1 * | 6/2012 | Mueller | B63B 23/32 414/137.7 |
| 2012/0321387 | A1 | 12/2012 | del Campo y Ruiz de Almodovar | |
| 2013/0104794 | A1 * | 5/2013 | Bolline | B63B 27/36 114/362 |
| 2014/0026805 | A1 * | 1/2014 | Mueller | B63B 27/143 114/362 |
| 2014/0060414 | A1 * | 3/2014 | Buck | B63B 27/143 114/259 |

* cited by examiner

SWIM LIFT

CROSS-REFERENCE TO RELATED APPLICATIONS

This application claims benefit of U.S. Provisional Patent Application No. 62/378,456 which was filed on Aug. 23, 2016, and which is incorporated herein in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention is in the technical field of lifting devices. More particularly, the preferred embodiments of the present invention relate generally to lifting devices for transitioning between the water and a boat. More particularly, the preferred embodiments of the present invention relate generally to marine lifting devices, which use hydraulics. More particularly, the preferred embodiments of the present invention relate generally to hydraulic marine lifting devices, which may be automatically stowed. More particularly, the preferred embodiments of the present invention relate generally to stowable hydraulic marine lifting devices, which lift a single standing swimmer out of the water.

2. Description of the Related Art

The broad concept of lifting devices for transitioning between the water and a boat is known. However, most of these devices require the manpower of the user to lift the user out of the water.

Marine lifting devices, which use hydraulics, are also known. However, these inventions usually involve large apparatuses, which are not easily removed from a boat or are not easily stowable.

It is also known to use marine lifting devices, which use scissors mechanisms. However, these devices are usually used for lifting large objects, such as personal watercraft, are not easily stowed when not in use.

It is also known to use swim lifts, which lift a single standing swimmer. However, these inventions are usually extended over the side of a boat and require participation of the user to climb over the side of a boat, and they are not compact or easily stowable.

SUMMARY OF THE INVENTION

Boating enthusiasts often enjoy swimming around the proximity of their boats; however, difficulties may arise when a swimmer wishes to enter the water or to return to the boat. Boat ladders can assist swimmers in climbing out of the water, but these ladders are often too short or make it difficult to transition between the water and the boat. The Swim Lift Invention was developed in part to overcome the problems involved in transitioning a swimmer between the water and the deck a boat. The broad embodiments of the present invention relate generally to an apparatus with a remotely controlled hydraulically actuated platform, upon which a swimmer may stand in order to be raised out of the water or lower into the water.

In the more preferred embodiments, the present invention relates a swim lift apparatus, which comprises a scissor mechanism in an assembly bolted underneath the swim deck of a boat, a hydraulic cylinder that extends the scissor mechanism, a retracting stand platform attached to the scissor mechanism that can slide inward and under the deck of the boat for storage when not in use, a hydraulic power unit that is situated inside a closed compartment behind the rear transom of the boat and is connected to the boat's 12-volt battery system, hydraulic hoses that run from the hydraulic power unit and through the transom or hull of the boat to the hydraulic cylinder that actuates the stand platform, and a wireless remote control that operates the hydraulic power unit. To enter the water from the boat, a swimmer stands on the stand platform and presses the down/extend button on the remote control, thereby activating the hydraulic cylinder to retract and extend the scissor mechanism thereby lowering the stand platform and the swimmer into the water. Releasing the down/extend button on the remote control at anytime stops the motion of the of the stand platform. To exit the water, a swimmer stands on the stand platform and presses the up/retract button on the remote control, thereby activating the hydraulic cylinder to extend the hydraulic ram and retract the scissor mechanism, thereby raising the stand platform and swimmer to the boat's deck. Releasing the up/retract button on the remote control at anytime stops the motion of the of the stand platform. Because of the compact nature of the Swim Lift Invention, the apparatus may be removed from its anchor on the swim deck of the boat and stored away when not in use.

In the most preferred embodiments, the present invention relates to an apparatus for raising or lowering a single swimmer into the water, which comprises a hydraulic cylinder that extends substantially above the swim deck of a boat, an anchor assembly for the hydraulic cylinder that is bolted underneath the swim deck of the boat using a mounting bracket, a stand platform attached to the hydraulic ram of the hydraulic cylinder, a guide and hand support that extends upward from the stand platform along the hydraulic cylinder, a hydraulic power unit that is situated inside a closed compartment behind the rear transom of the boat and is connected to the boat's 12-volt battery system, hydraulic hoses that run from the hydraulic power unit and through the transom or hull of the boat to the hydraulic cylinder that actuates the stand platform, and a wireless remote control that operates the hydraulic unit. To enter the water from the boat, a swimmer stands on the stand platform and presses the down/extend button on the remote control, thereby activating the hydraulic cylinder to extend the hydraulic ram and lower the stand platform and the swimmer into the water. Releasing the down/extend button on the remote control at anytime stops the motion of the of the stand platform. To exit the water, a swimmer stands on the stand platform and presses the up/retract button on the remote control, thereby activating the hydraulic cylinder to retract the hydraulic ram and raise the stand platform and swimmer to the boat's deck. Releasing the up/retract button on the remote control at anytime stops the motion of the of the stand platform. Because of the compact nature of the Swim Lift Invention, the apparatus may be removed from its anchor on the swim deck of the boat and stored away when not in use. The Swim Lift invention provides a convenient and stowable apparatus for lifting a single swimmer into or out of the water onto the swim deck of a boat.

BRIEF DESCRIPTION OF THE DRAWING

Illustrative and preferred embodiments of the present invention are shown in the accompanying drawings in which.

DETAILED DESCRIPTION OF THE PREFERRED EMBODIMENTS

For the purpose of illustration, the present invention is shown in the most preferred embodiments of a swim lift apparatus, which mounts under the swim deck of a boat and hydraulically actuates a platform that lifts a standing swimmer out of the water and up to the level of the swim deck of a boat and which may be stowed under the swim deck of the boat when not in use. These embodiments are not intended to limit the scope of the present invention.

Figure 1:
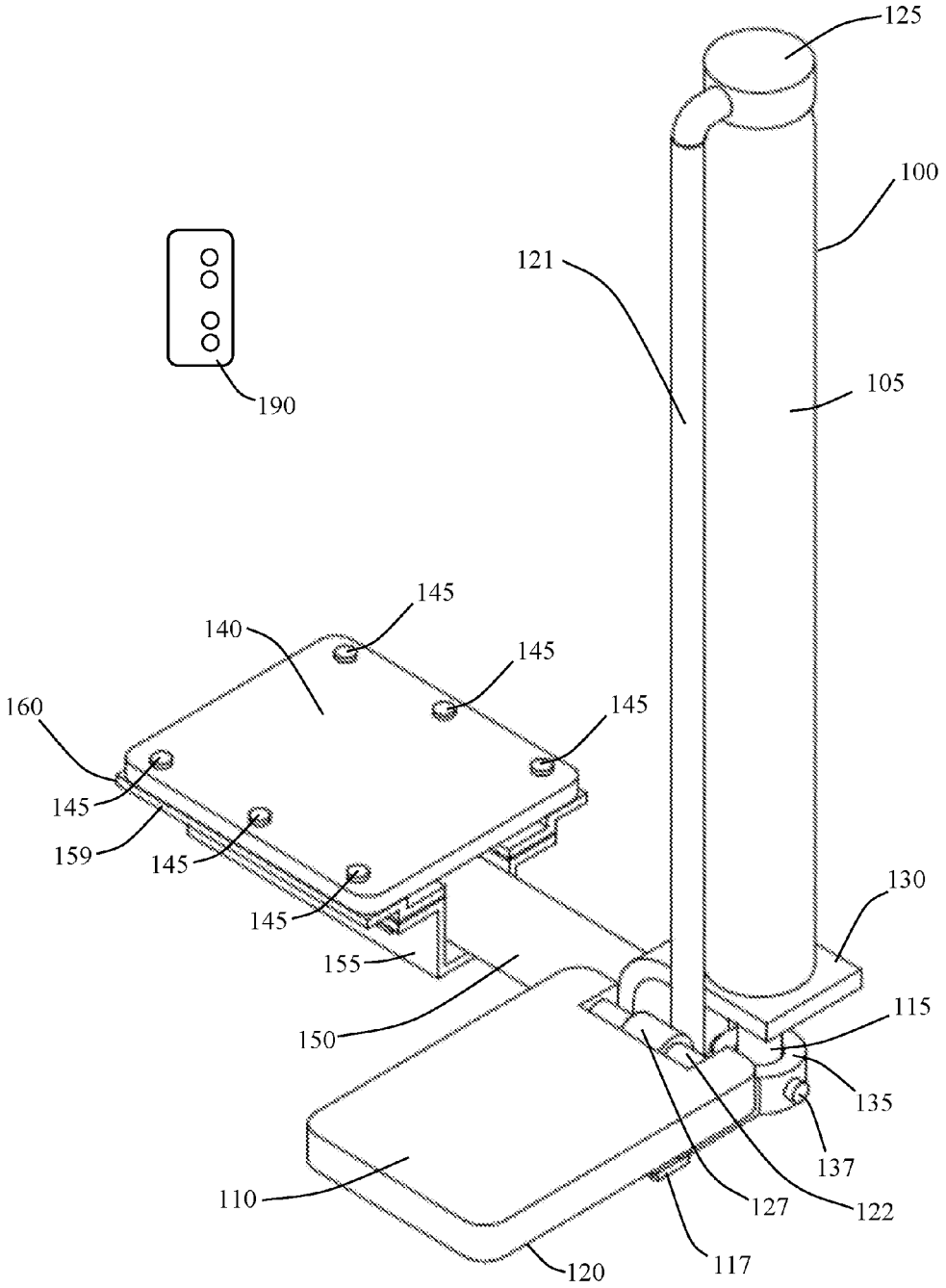
FIG. 1 is a front perspective view of the most preferred embodiment of an apparatus of the present invention.
Figure 2:
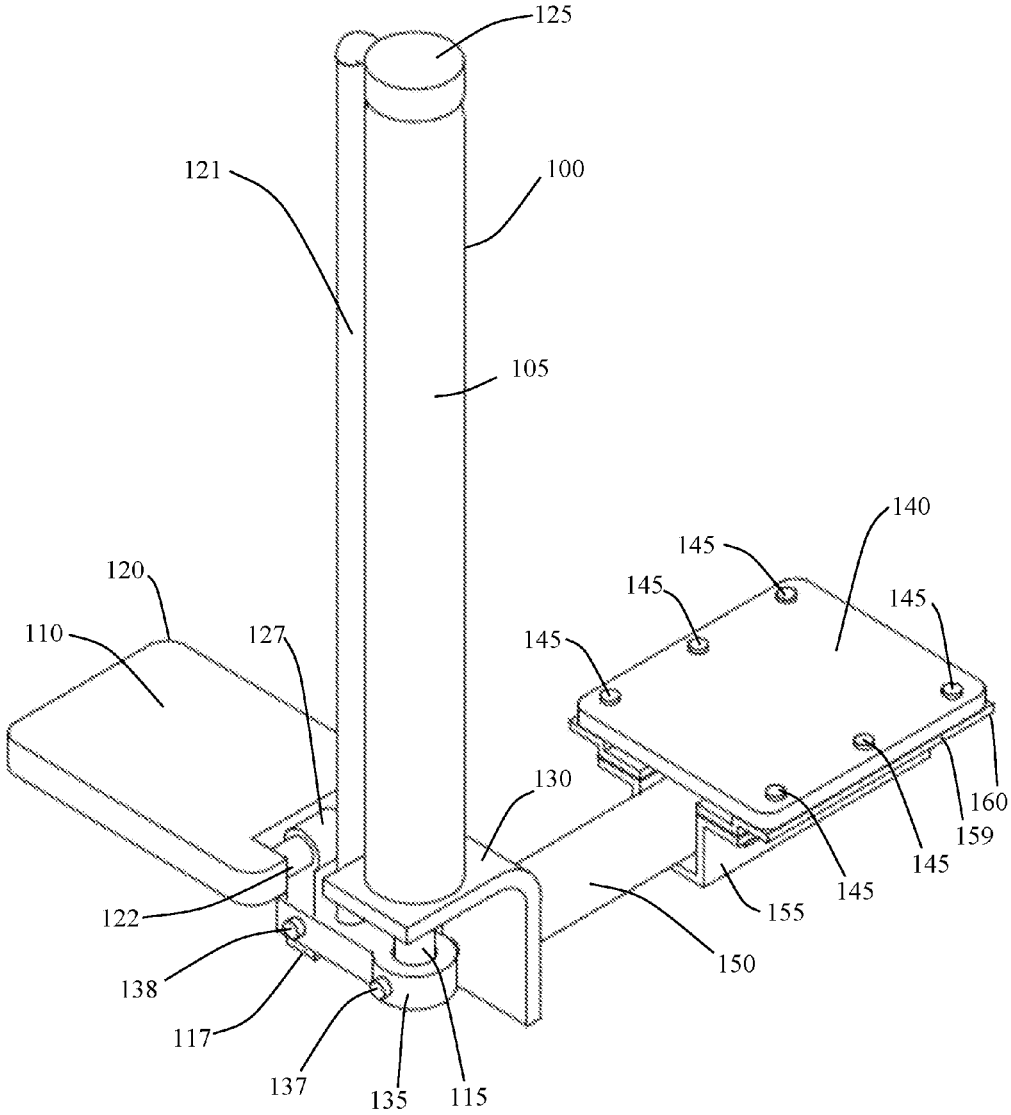
FIG. 2 is a rear perspective view of an apparatus of FIG. 1.
Figure 3:
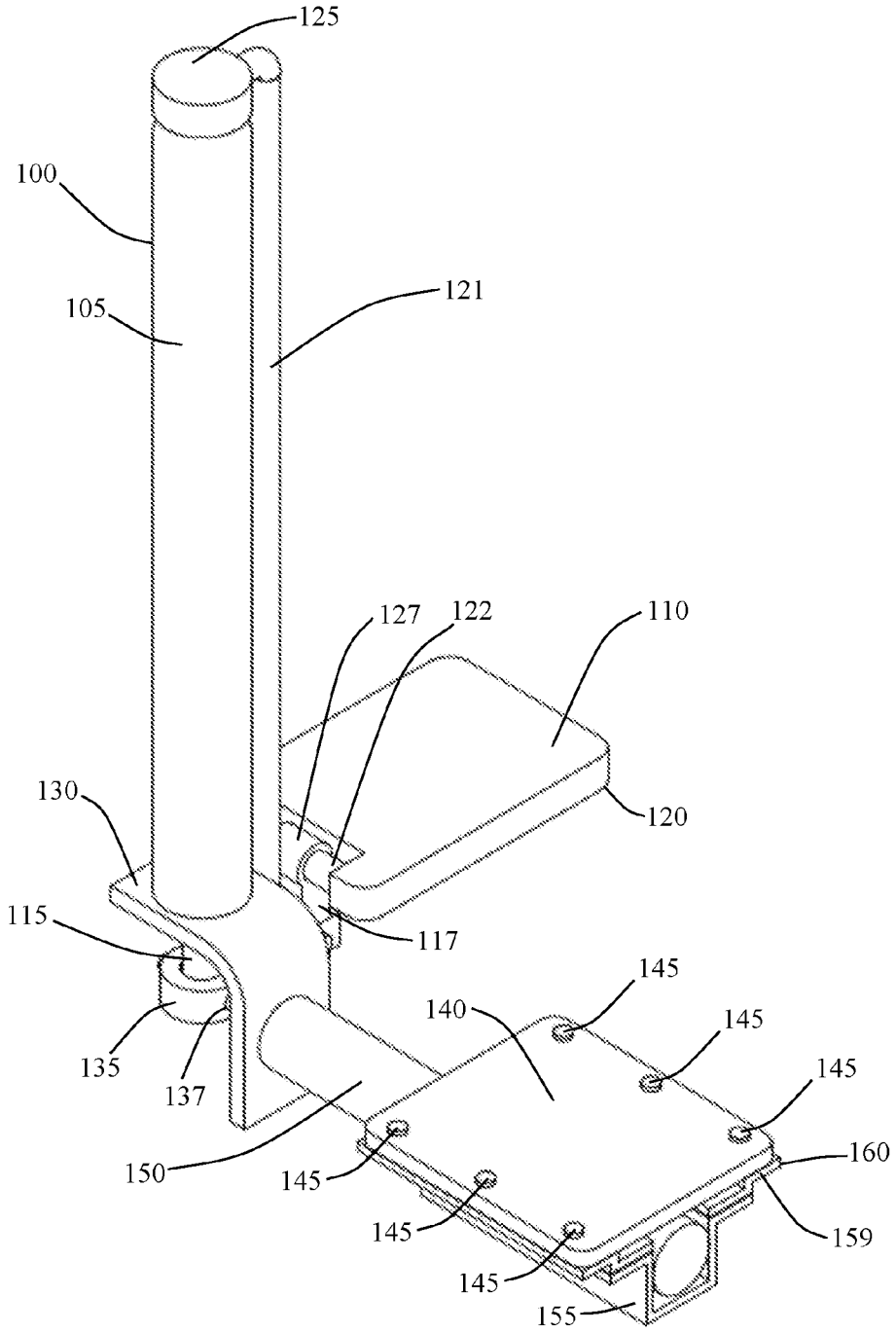
FIG. 3 is a right side perspective view of an apparatus of FIG. 1.
Figure 4:
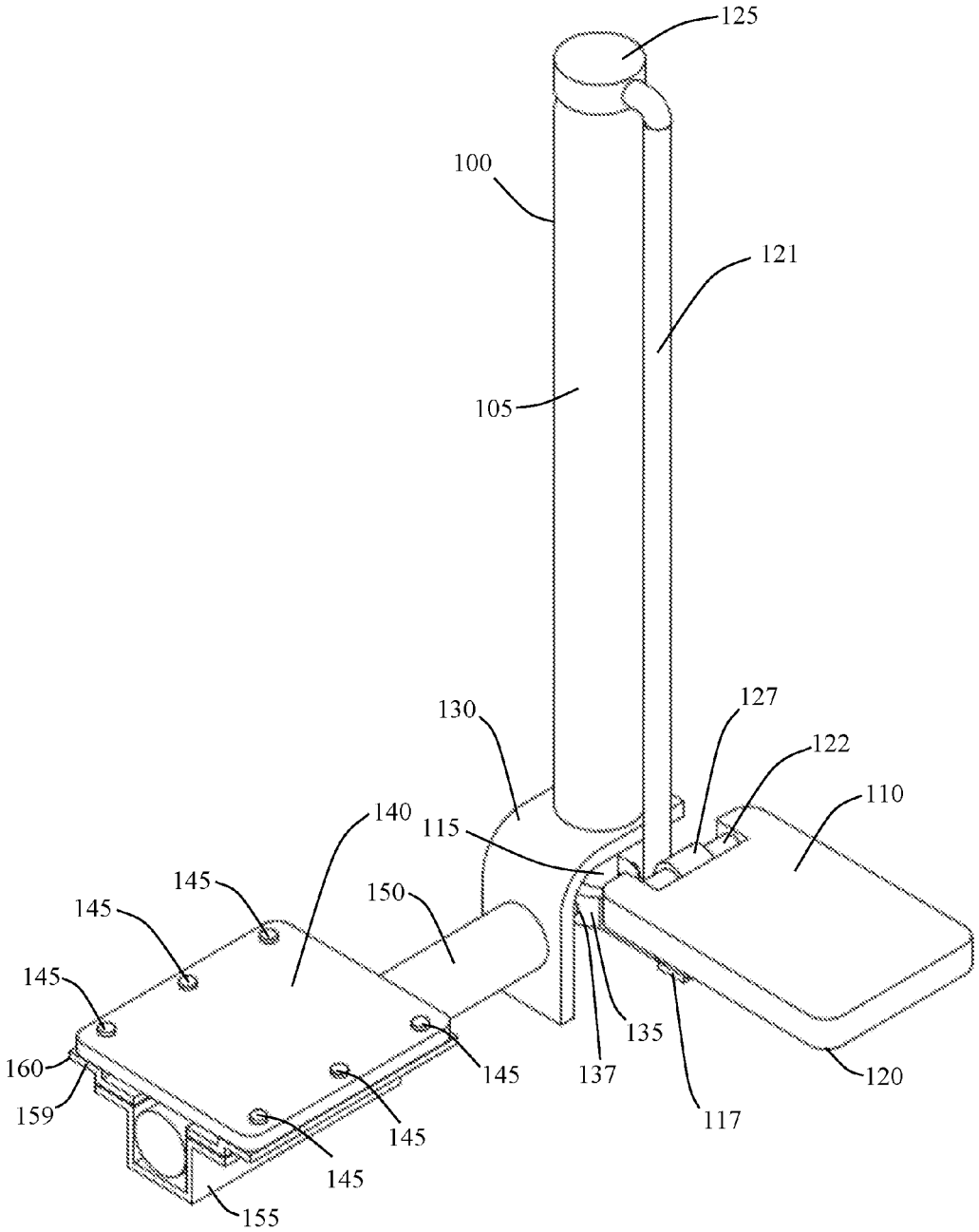
FIG. 4 is a left side perspective view of an apparatus of FIG. 1.
Figure 5:
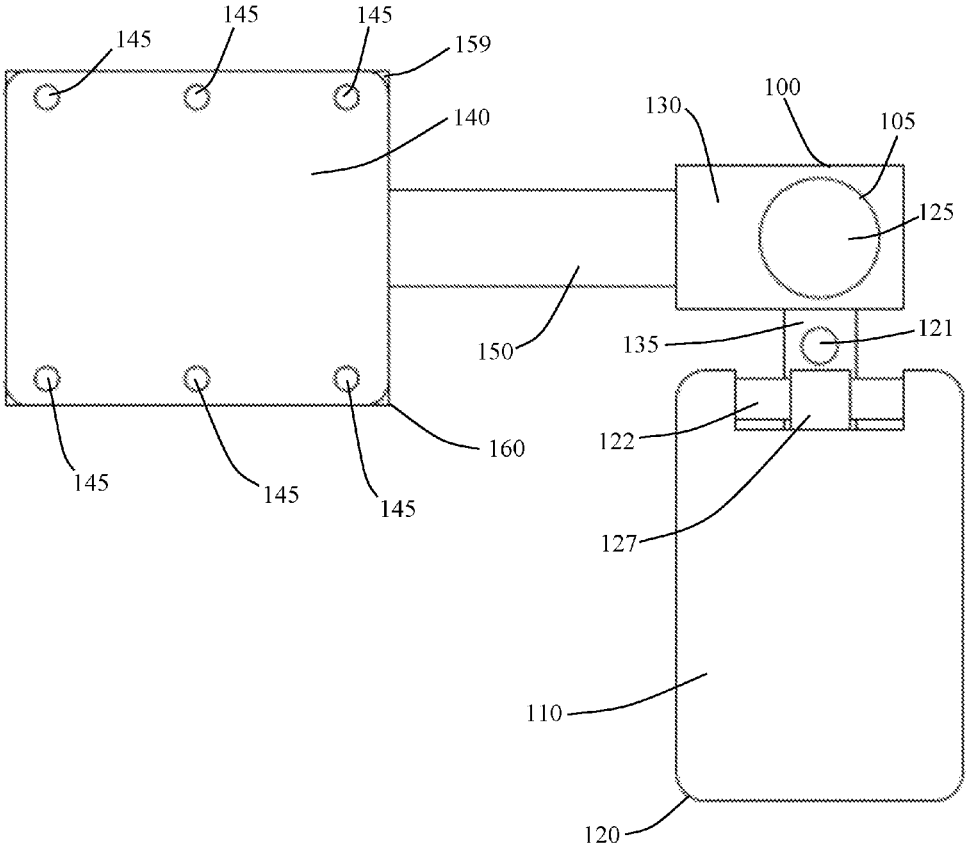
FIG. 5 is a top view of an apparatus of FIG. 1.
Figure 6:
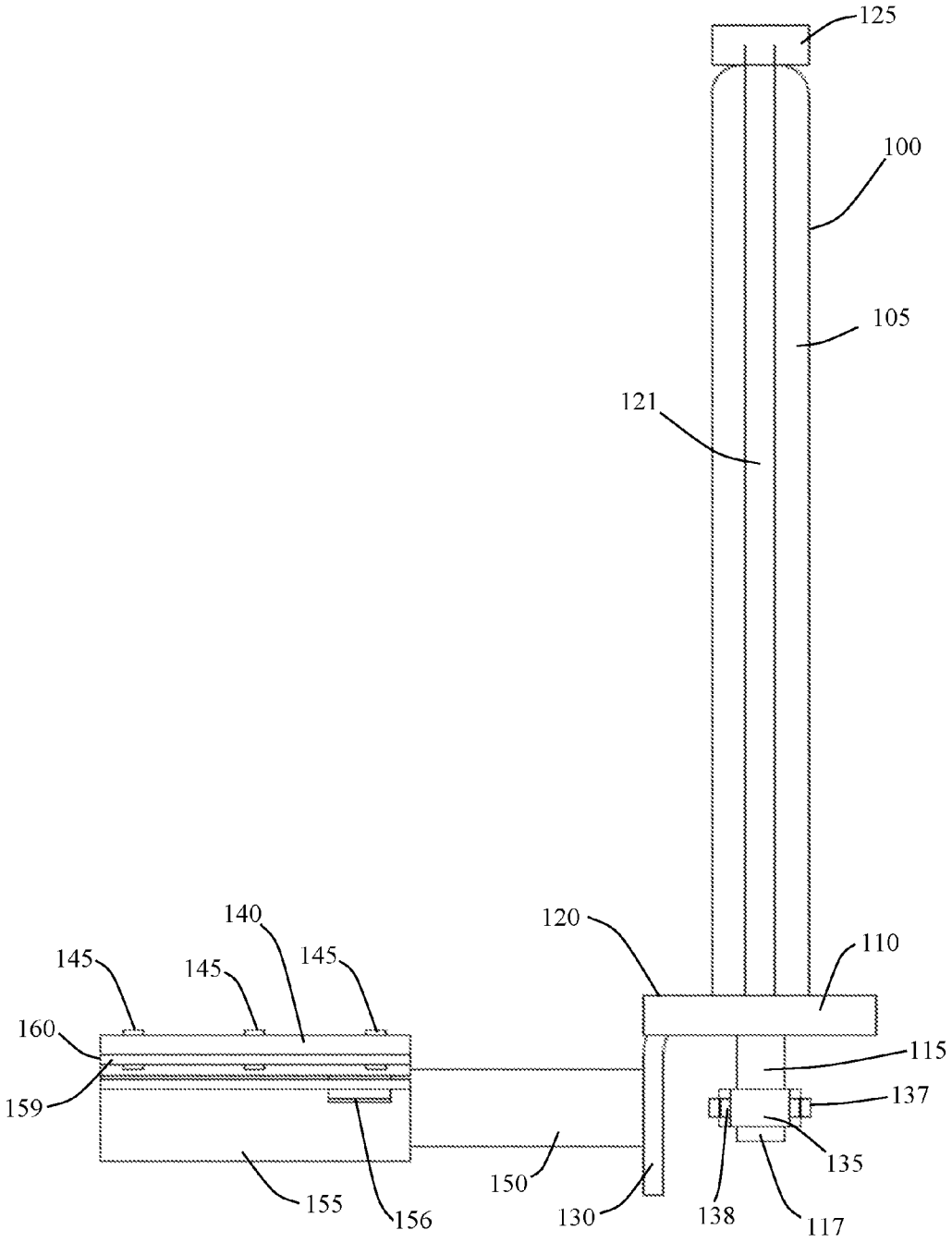
FIG. 6 is a front view of an apparatus of FIG. 1.
Figure 7:
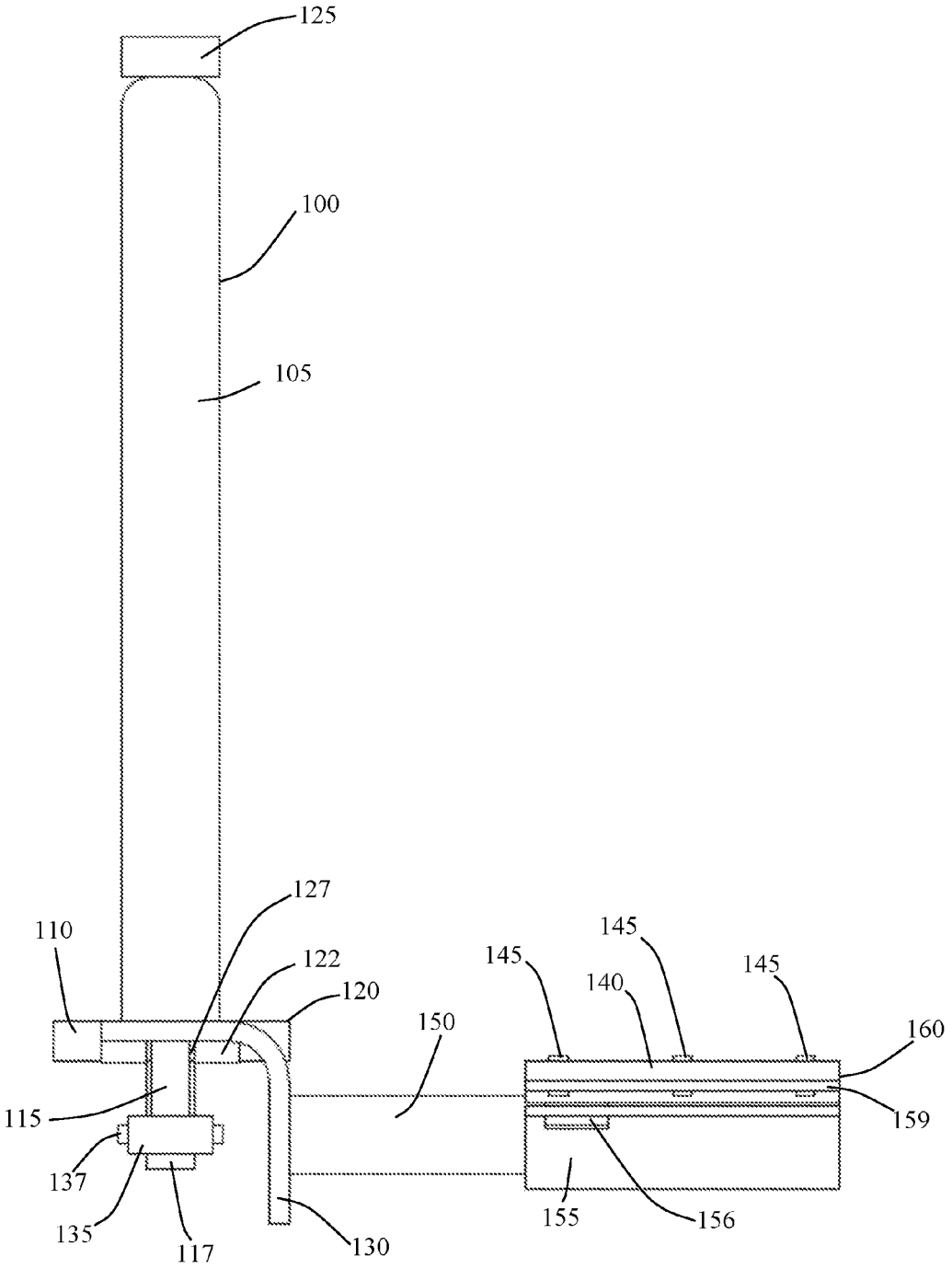
FIG. 7 is a rear view of an apparatus of FIG. 1.
Figure 8:
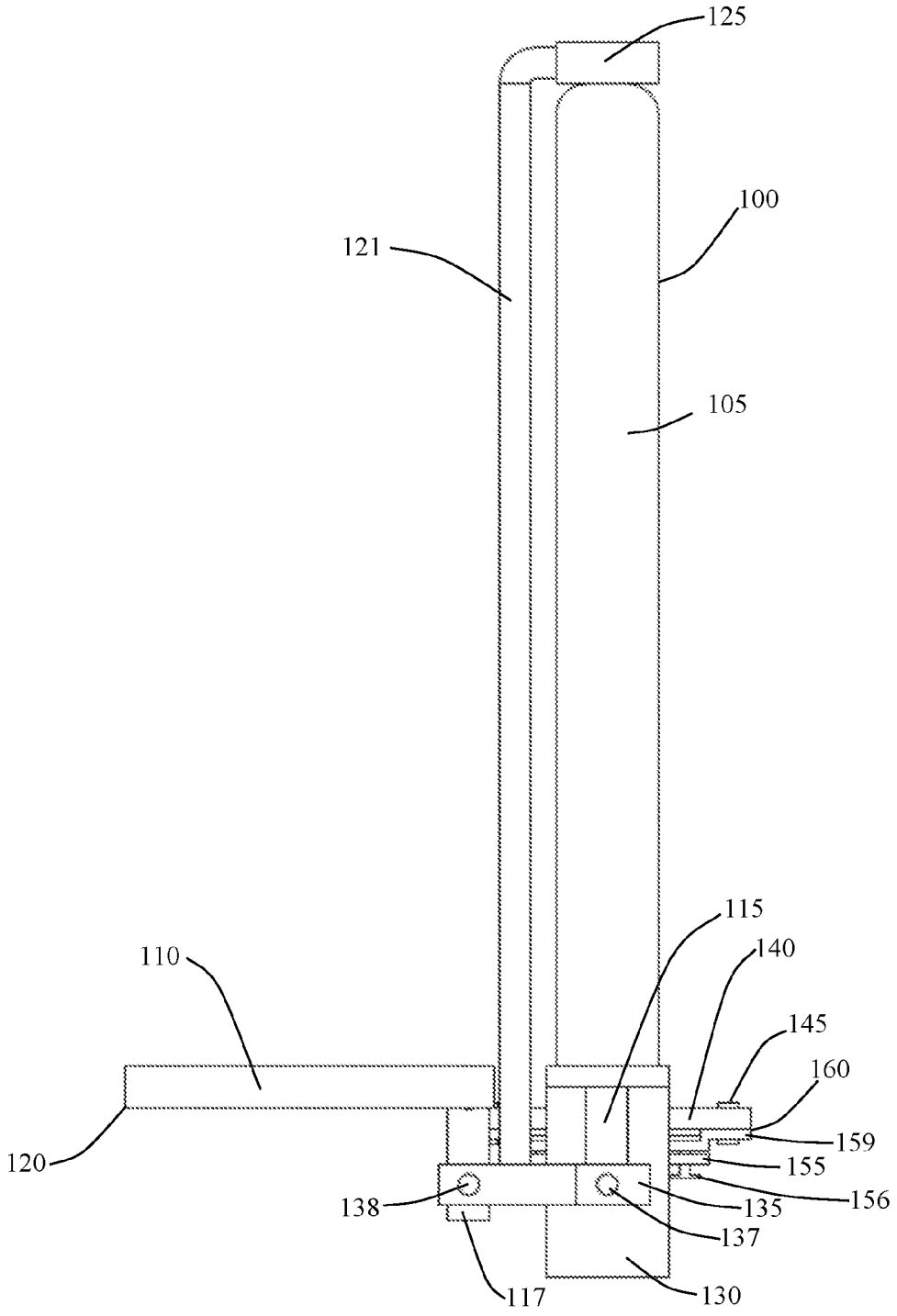
FIG. 8 is a right side view of an apparatus of FIG. 1.
Figure 9:
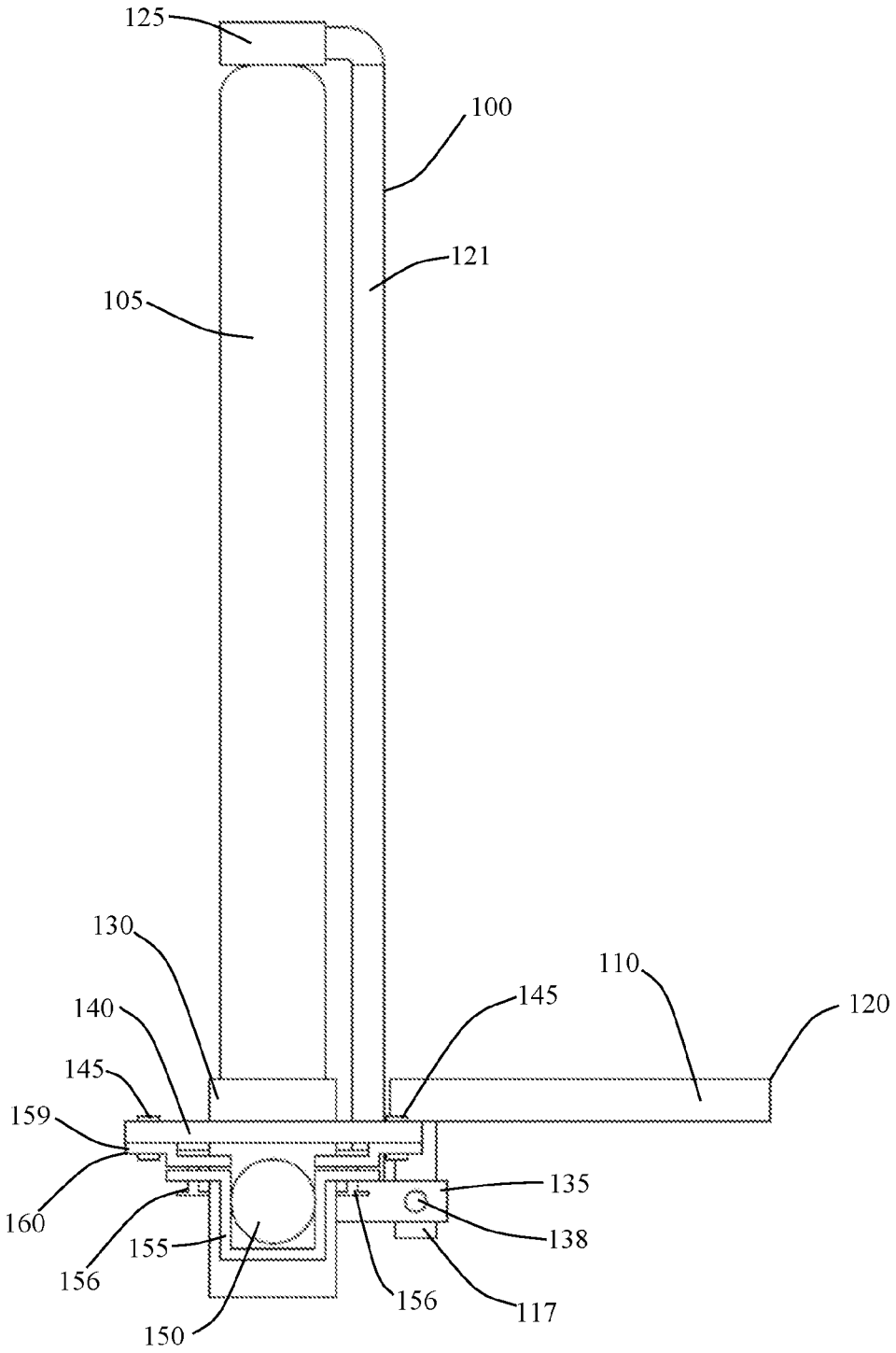
FIG. 9 is a left side view of an apparatus of FIG. 1.
Figure 10:
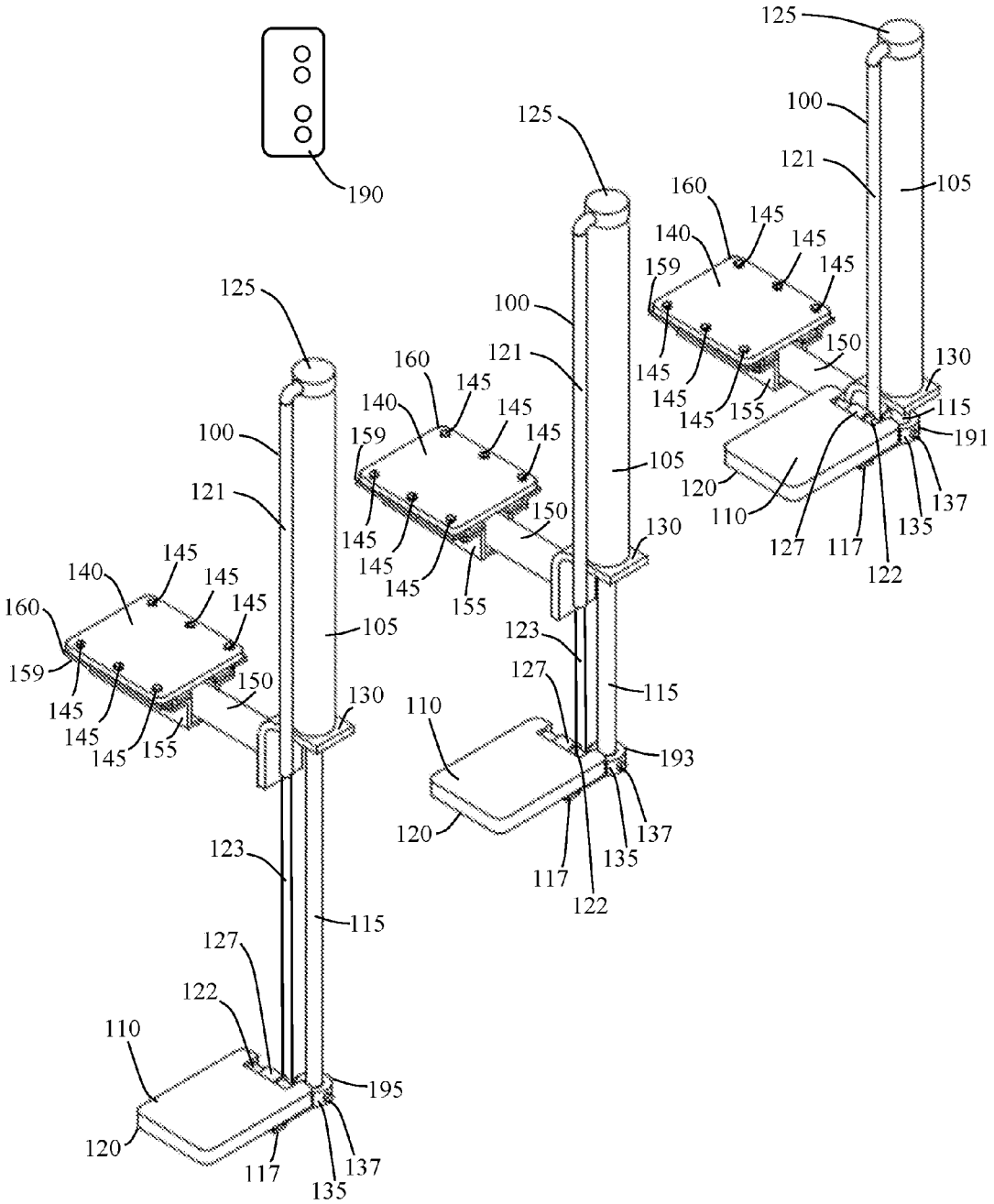
FIG. 10 is a set of front perspective views showing an apparatus of FIG. 1 in an upper position, a middle position, and a lower position.
Figure 11:
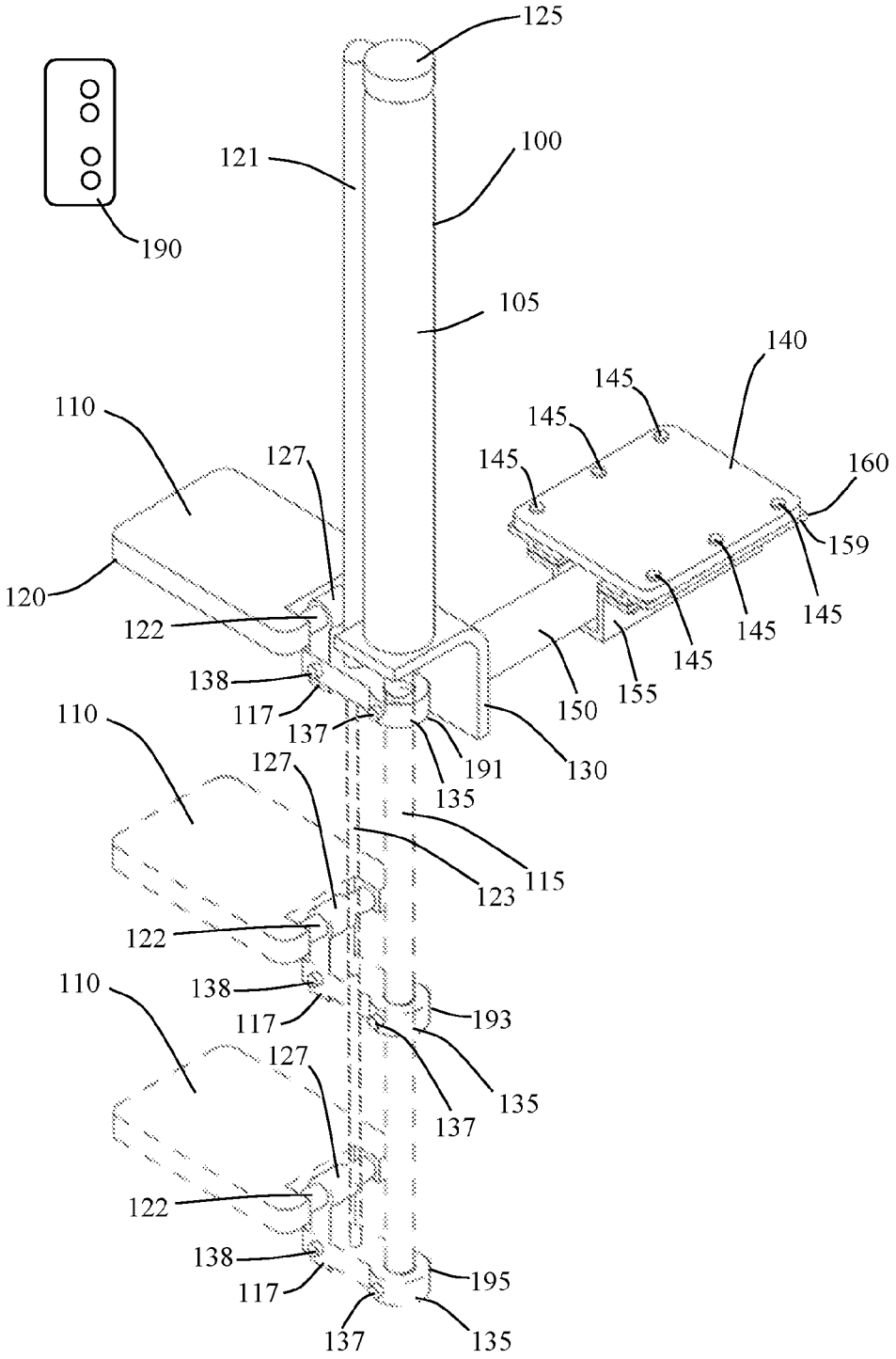
FIG. 11 is a rear perspective view of an apparatus of FIG. 1 in an upper position and shows a middle position and a lower position overlaid in dotted lines.
Figure 12:
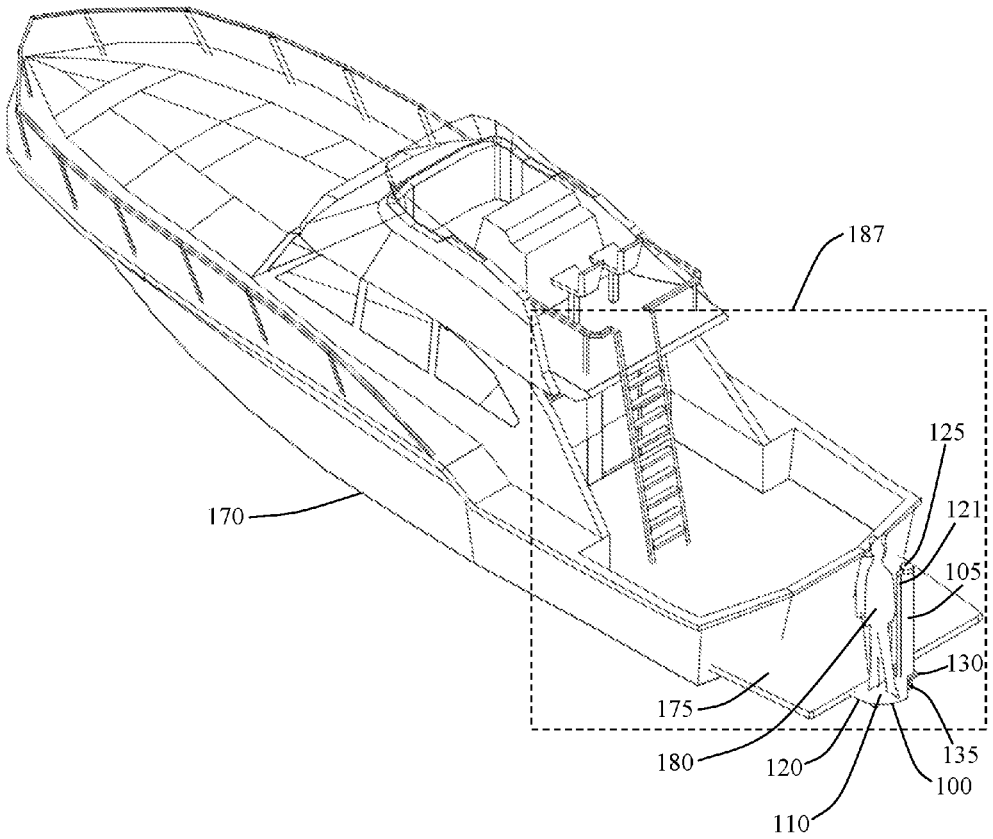
FIG. 12 is a perspective view of an apparatus of FIG. 1 mounted under the swim deck of a boat and shows a user standing on the apparatus.
Figure 13:
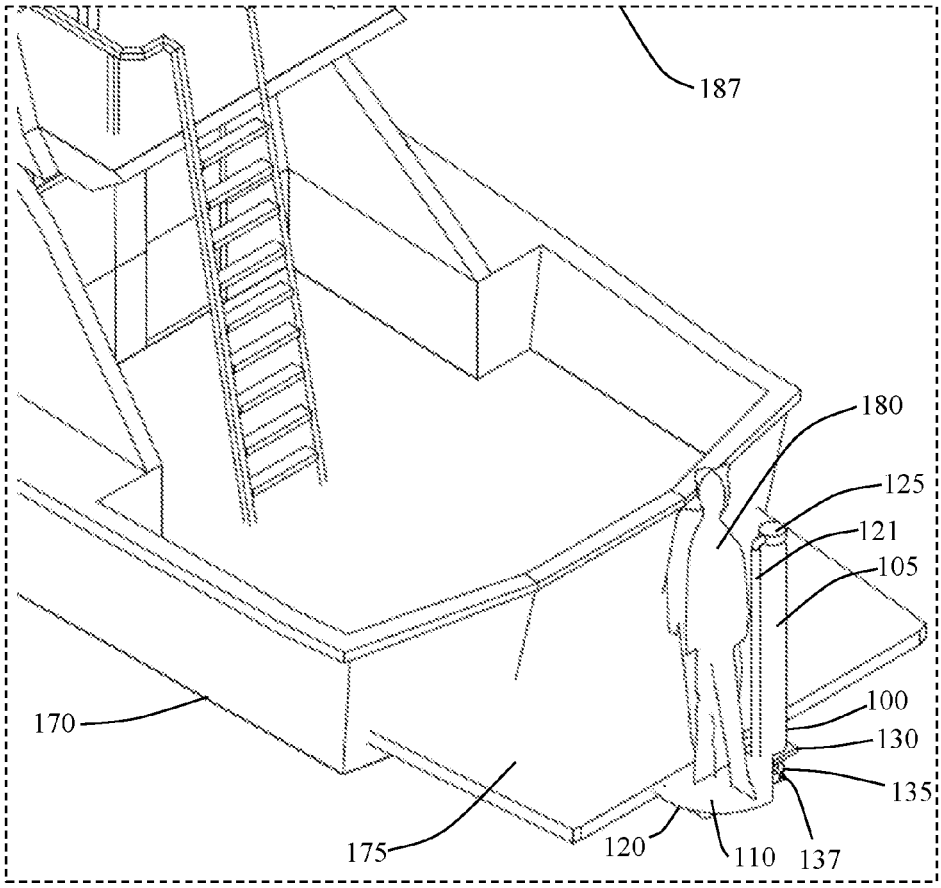
FIG. 13 is a close-up perspective view of an apparatus of FIG. 12 mounted under the swim deck of a boat and shows a user standing on the apparatus.
Figure 14:
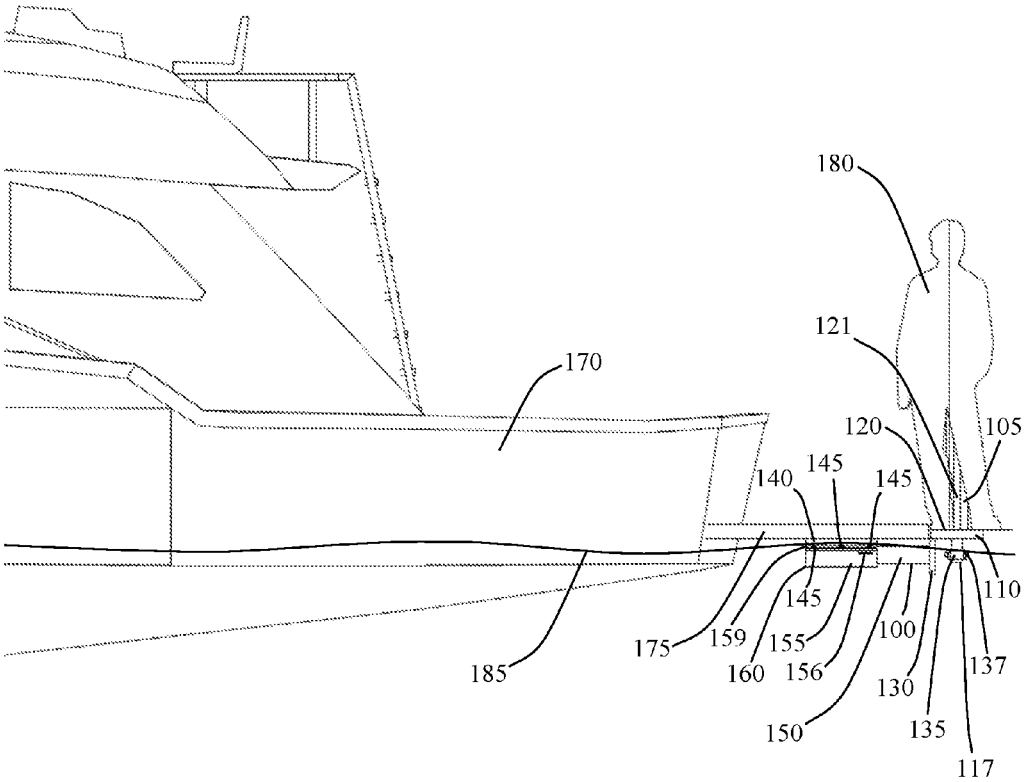
FIG. 14 is a side view of an apparatus of FIG. 1 mounted under the swim deck of a boat and shows a user standing on the apparatus.
Figure 15:
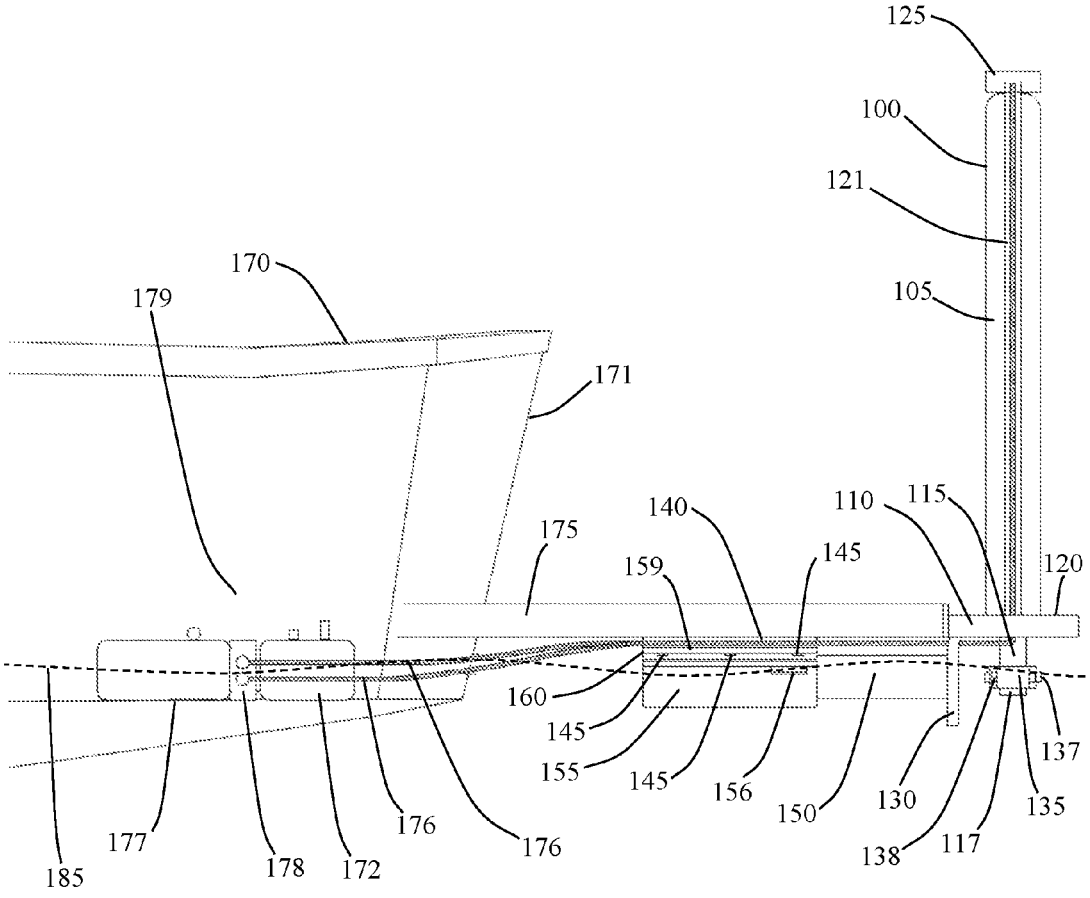
FIG. 15 is a side cutaway view of an apparatus of FIG. 1 mounted under the swim deck of a boat, which shows a hydraulic power unit mounted inside the boat.
Figure 16:
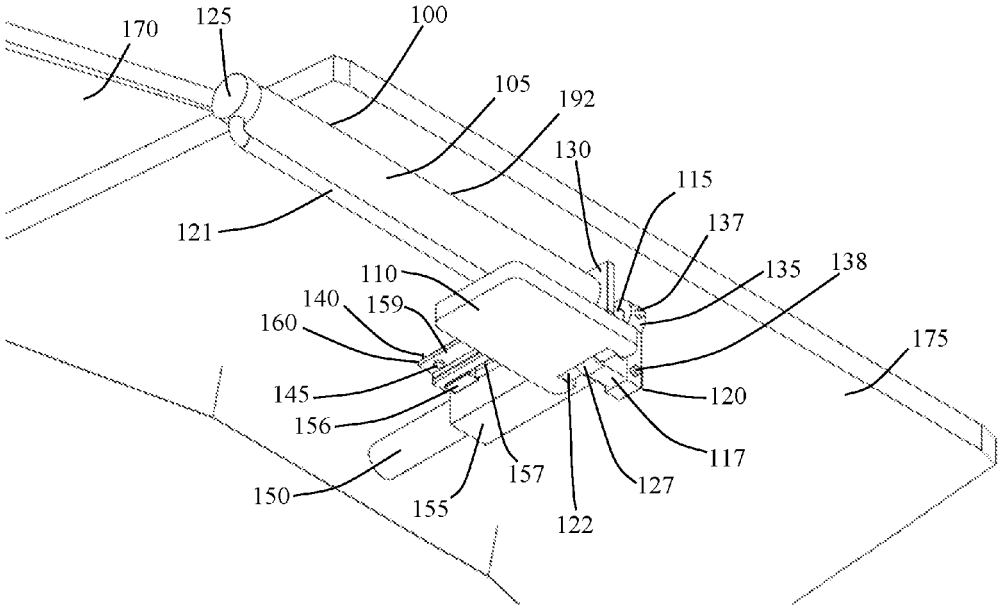
FIG. 16 is a perspective view of an apparatus of FIG. 1 mounted under a swim deck of a boat and in a stowed configuration.
Figure 17:
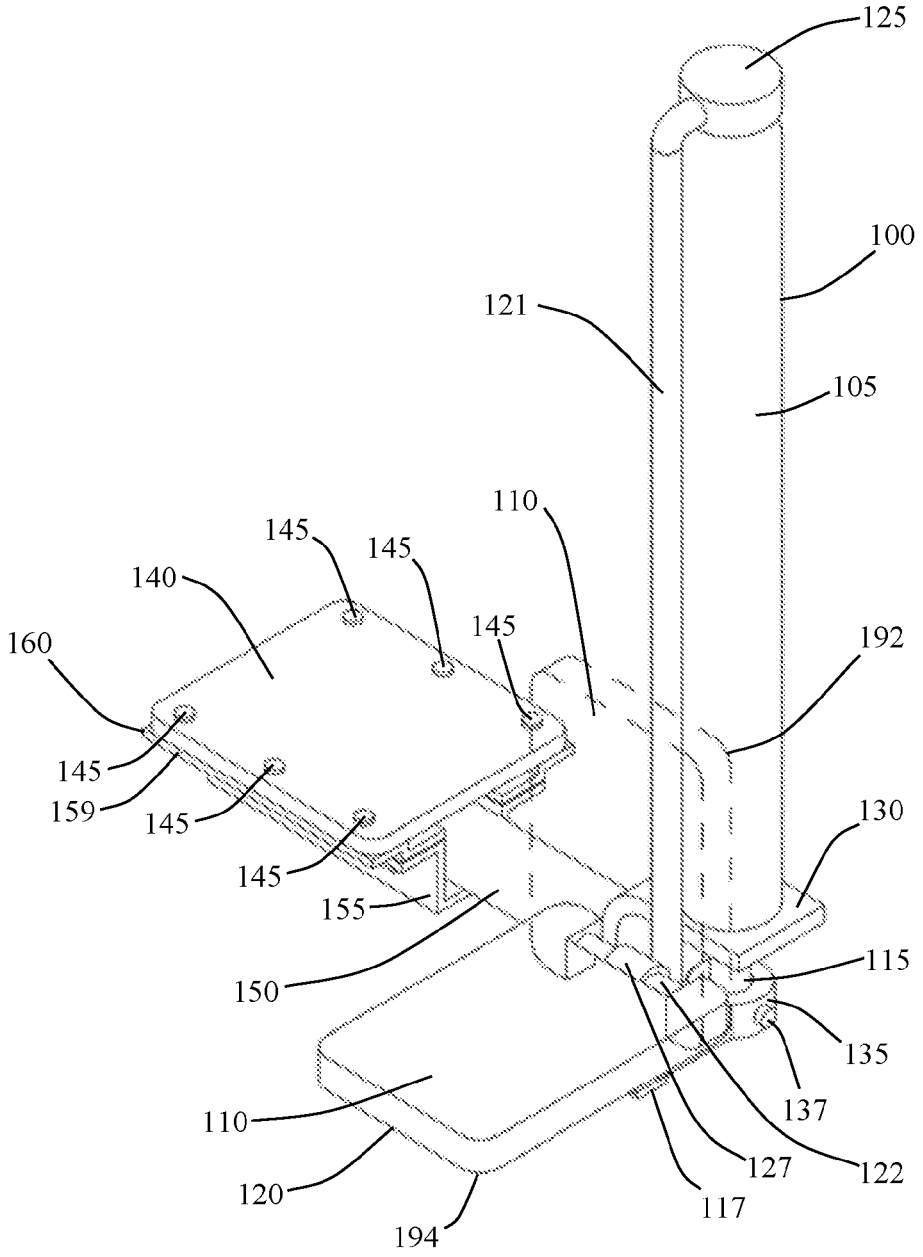
FIG. 17 is a front perspective view of an apparatus of FIG. 1 in the process of attaining a stowed configuration.
Figure 18:
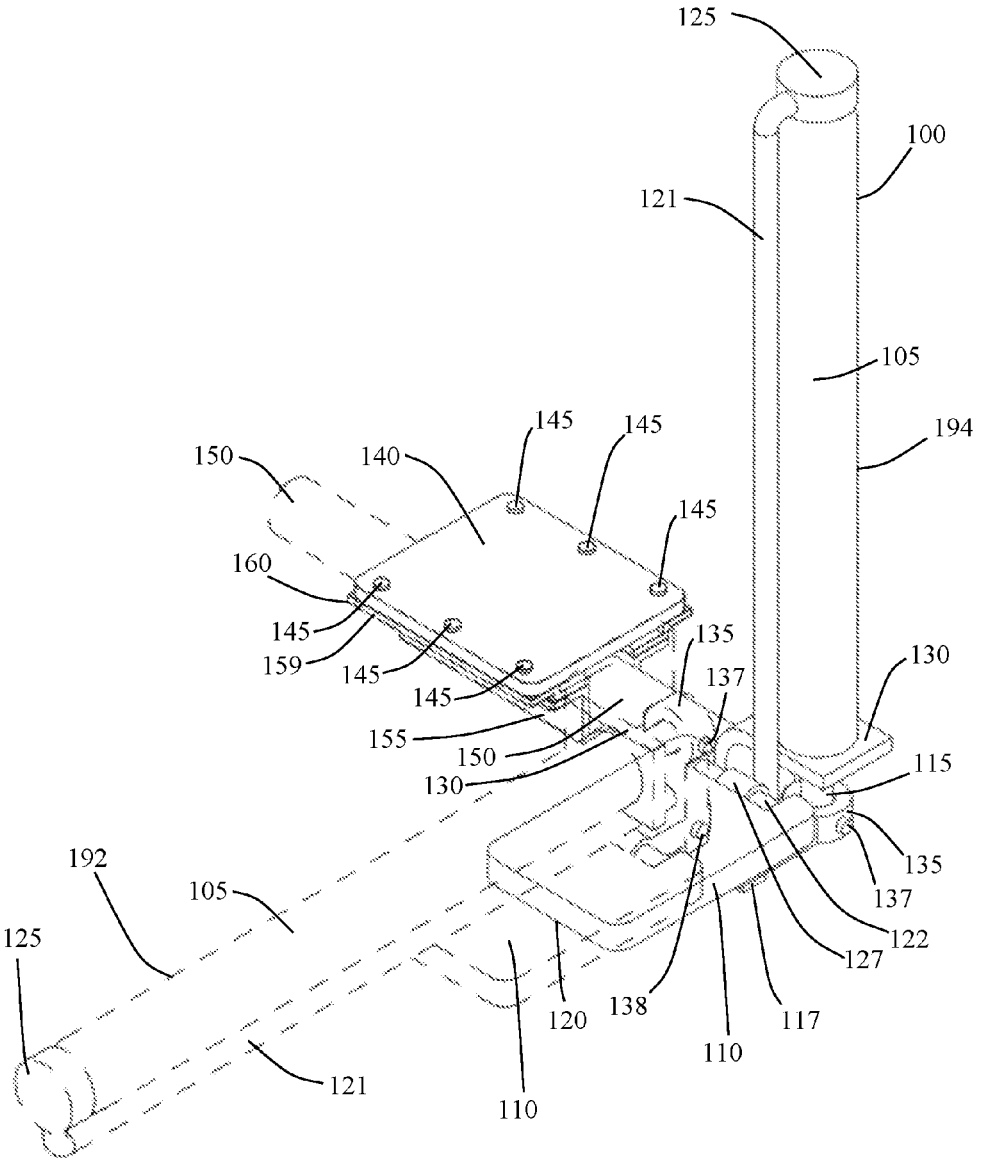
FIG. 18 is a front perspective view of an apparatus of FIG. 1 in the process of attaining a stowed configuration.
Figure 19:
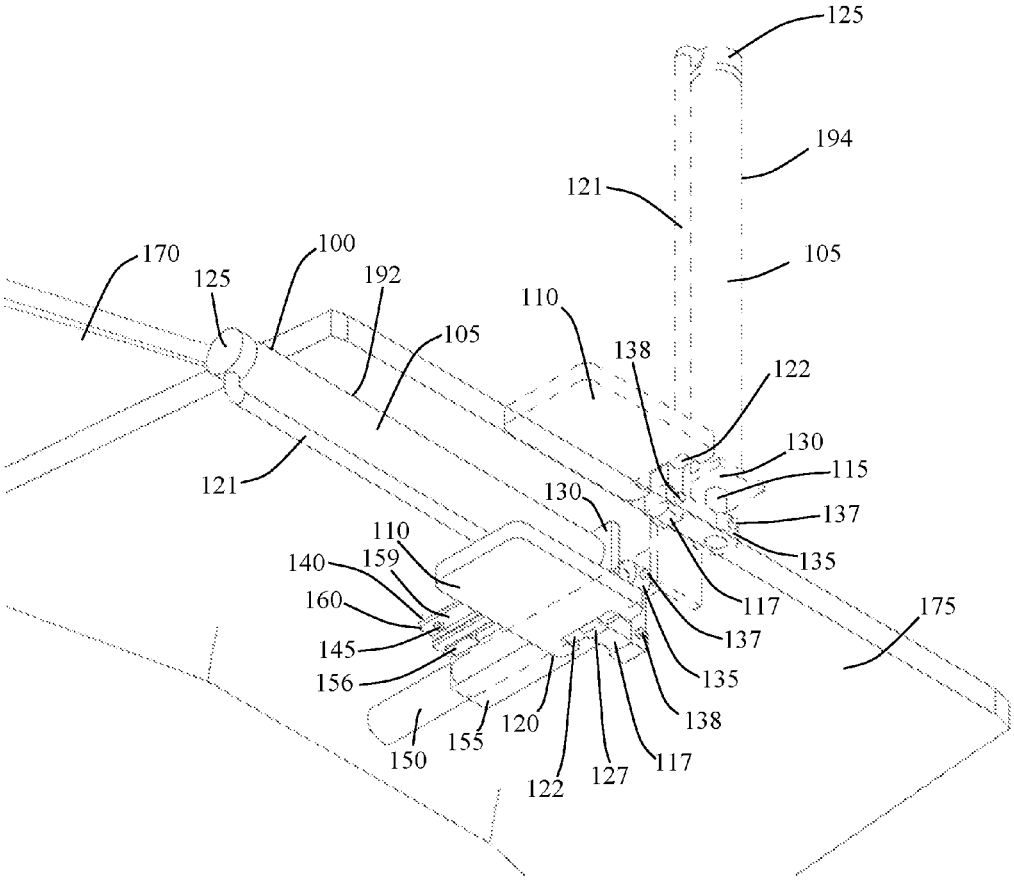
FIG. 19 is a perspective view of an apparatus of FIG. 1 mounted under a swim deck of a boat and in a stowed configuration with a deployed configuration displayed with dotted lines.

The Swim Lift invention was developed in part to allow a swimmer to easily transition from the water to the swim deck of a boat or from the swim deck of a boat into the water. Additionally, the Swim Lift invention may be easily stowed under the swim deck of a boat when not in use. Referring now to the most preferred embodiment of the invention, in FIG. 1, FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16, FIG. 17, FIG. 18 and FIG. 19, an Above-Deck Swim Lift 100 is shown. FIG. 1 illustrates a front perspective view of an Above-Deck Swim Lift 100 with an Above-Deck wireless remote 190. FIG. 2 depicts a rear perspective view of an Above-Deck Swim Lift 100. FIG. 3 shows a right side perspective view of an Above-Deck Swim Lift 100. FIG. 4 displays a left side perspective view of an Above-Deck Swim Lift 100. FIG. 5 shows a top view of an Above-Deck Swim Lift 100. FIG. 6 depicts a front view of an Above-Deck Swim Lift 100. FIG. 7 illustrates a rear view of an Above-Deck Swim Lift 100. FIG. 8 demonstrates a right side view of an Above-Deck Swim Lift 100. FIG. 9 shows a left side view of an Above-Deck Swim Lift 100. FIG. 10 displays a set of front perspective views showing an Above-Deck Swim Lift 100 in an Above-Deck upper position 191, an Above-Deck middle position 193, and an Above-Deck lower position 195, and showing an Above-Deck wireless remote 190. FIG. 11 depicts a rear perspective view of an Above-Deck Swim Lift 100 in an Above-Deck upper position 191, which shows an Above-Deck middle position 193 and an Above-Deck lower position 195 overlaid in dotted lines, and showing an Above-Deck wireless remote 190. FIG. 12 shows a perspective view of an Above-Deck Swim Lift 100 mounted under the swim deck 175 of a boat 170 and showing a user 180 standing on the Above-Deck stand platform 110 of an Above-Deck Swim Lift 100 and indicating an Above-Deck close-up box 187 with dotted lines. FIG. 13 illustrates a close-up perspective view of the Above-Deck close-up box 187 of FIG. 12, showing an Above-Deck Swim Lift 100 mounted under the swim deck 175 of a boat 170 and showing a user 180 standing on the Above-Deck stand platform 110 of an Above-Deck Swim Lift 100. FIG. 14 depicts a side view of an Above-Deck Swim Lift 100 mounted under the swim deck 175 of a boat 170 and showing a user 180 standing on the Above-Deck stand platform 110 of an Above-Deck Swim Lift 100 and indicating a water line 185. FIG. 15 shows a side cutaway view of an Above-Deck Swim Lift 100 mounted on the swim deck 175 of a boat 170, which shows an Above-Deck hydraulic power unit 177 mounted inside the boat 170 in a closed compartment 179 behind the rear transom of the boat 170 and which indicates a water line 185. FIG. 16 demonstrates a perspective view of an Above-Deck Swim Lift 100 mounted under a swim deck 175 of a boat 170 and in the Above-Deck stowed configuration 192. FIG. 17 depicts a front perspective view of an Above-Deck Swim Lift 100 in the process of attaining an Above-Deck stowed configuration 192 with an Above-Deck deployed configuration 194 displayed in solid lines and the Above-Deck stand platform 110 displayed in dotted lines in the Above-Deck stowed configuration 192. FIG. 18 displays a front perspective view of an Above-Deck Swim Lift 100 in the process of attaining an Above-Deck stowed configuration 192 with an Above-Deck deployed configuration 194 displayed in solid lines and an Above-Deck stowed configuration 192 displayed in dotted lines. FIG. 19 illustrates a perspective view of an Above-Deck Swim Lift 100 mounted under a swim deck 175 of a boat 170 with an Above-Deck deployed configuration 194 displayed in dotted lines and an Above-Deck stowed configuration 192 displayed in solid lines.

Referring still to the most preferred embodiment of the invention, in FIG. 1, FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16, FIG. 17, FIG. 18 and FIG. 19, the Above-Deck Swim Lift 100 comprises an Above-Deck anchor assembly 160, which is bolted underneath a swim deck 175 of a boat 170; an Above-Deck lift assembly 120, which is connected to the Above-Deck anchor assembly and which extends substantially above the swim deck 175 of the boat 170; an Above-Deck hydraulic power unit 177, which is situated inside a closed compartment 179 behind the rear transom of the boat 170 and is connected to the boat's 12-volt battery system 172; Above-Deck hydraulic hoses 176 that run from the Above-Deck hydraulic power unit 177 and through the hull 171 of a boat 170 to the Above-Deck lift assembly 120; and an Above-Deck wireless remote control 190, which operates the Above-Deck hydraulic power unit 177. The Above-Deck anchor assembly 160 further comprises an Above-Deck mounting bracket 140, which attaches to the underside of the swim deck 175 of the boat 170 using a plurality of Above-Deck mounting bolts 145; a middle mounting bracket 159, which attaches to the Above-Deck mounting bracket 140 using the plurality of Above-Deck mounting bolts 145; a support arm sleeve 155, which attaches to the middle mounting bracket 159 using sleeve bolts 156; and a support arm 150. The Above-Deck lift assembly 120 further comprises an Above-Deck hydraulic cylinder 105, which extends an Above-Deck hydraulic ram 115 below the swim deck 175 of the boat 170; a cap, which is mounted on top of the Above-Deck hydraulic cylinder 105; an upper guide post 121, which is hollow, extends from the cap 125, and runs parallel to the Above-Deck hydraulic cylinder 105; a hydraulic base 130, which has right angle surfaces and which connects to the support arm 150 and to the Above-Deck hydraulic cylinder 105; a platform base 135, which connects to the Above-Deck hydraulic ram 115 using a ram bolt 137; a lower guide post 123, which is connected to the platform base 135 and which telescopically extends from the interior of the upper guide post 121, thereby providing stabilization during extension and retraction; a platform arm 117, which attaches to the platform base 135 using an arm bolt 138 and extends upward ending in a hinge knuckle 127; and an Above-Deck stand platform 110, which connects to the platform arm 117 using a hinge pin 122, upon which a user 180 may stand.

In further detail, referring still to FIG. 1, FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16, FIG. 17, FIG. 18 and FIG. 19; in FIG. 10 and FIG. 11 a sequence of events are depicted, which describe the motion of an Above-Deck Swim Lift 100 as it lowers the Above-Deck stand platform 110 into the water. First, in the Above-Deck upper position 191, the Above-Deck hydraulic ram 115 is fully retracted into the Above-Deck hydraulic cylinder 105, and the Above-Deck stand platform 110 is at the highest position at substantially the same level of the swim deck 175 of the boat 170, so that a user 180 may easily step from the swim deck 175 to the Above-Deck stand platform 110. To initiate the motion of the Above-Deck Swim Lift 100, the user 180 uses the Above-Deck wireless remote 190 to activate the Above-Deck hydraulic power unit 177 and extend the Above-Deck hydraulic ram 115. During transition to the Above-Deck lower position 195, the Above-Deck Swim Lift 100 reaches an Above-Deck middle position 193. In an Above-Deck middle position 193, the Above-Deck hydraulic ram 115 is partially extended from the Above-Deck hydraulic cylinder 105, and the Above-Deck stand platform 110 is transitioned deeper into the water along with the lower guide post 123. In the Above-Deck lower position 195, the Above-Deck hydraulic ram 115 is fully extended from the Above-Deck hydraulic cylinder 105, and the Above-Deck is at its lowest position in the water. For a user 180 to be lifted out of the water, while swimming or in the water a user 180 stands upon the Above-Deck stand platform 110 with the Above-Deck Swim Lift 100 in the Above-Deck lower position 195. The user 180 then uses the Above-Deck wireless remote 190 to activate the Above-Deck hydraulic power unit 177 to retract the Above-Deck hydraulic ram 115 into the Above-Deck hydraulic cylinder 105, thereby lifting the Above-Deck stand platform 110 and the user 180 out of the water. Releasing the Above-Deck wireless remote 190 at anytime stops the motion of the Above-Deck stand platform 110. When the Above-Deck Swim Lift 100 reaches the Above-Deck upper position 191, the Above-Deck hydraulic ram 115 is fully retracted into the Above-Deck hydraulic cylinder 105, and the Above-Deck stand platform 110 is at substantially the same level of the swim deck 175 of the boat 170, so that the user 180 may easily step from the Above-Deck stand platform 110 to the swim deck 175 of the boat 170.

In further detail, referring still to FIG. 1, FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16, FIG. 17, FIG. 18 and FIG. 19; in FIG. 16, FIG. 17, FIG. 18 and FIG. 19, a sequence of events are depicted, which describe the process of setting an Above-Deck Swim Lift 100 into an Above-Deck stowed configuration 192. First, while the support arm sleeve 155 is in an Above-Deck deployed configuration 194, the Above-Deck stand platform 110 is rotated upward using the hinge created by the hinge knuckle 127 and the hinge pin 122 so that the Above-Deck stand platform 110 is pointed upward. Next, the Above-Deck lift assembly 120 is rotated 90 degrees downward and the support arm 150 is retracted through the support arm sleeve 155, so that the Above-Deck Swim Lift 100 is substantially stowed under the swim deck 175 of the boat 170. At this point, the Above-Deck Swim Lift 100 is in the Above-Deck stowed configuration 192.

The construction details of the invention as shown in FIG. 1, FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16, FIG. 17, FIG. 18 and FIG. 19, are as follows. The Above-Deck hydraulic power unit 177 comprises a standard hydraulic actuator or the like. The Above-Deck hydraulic hoses 176 comprise standard hydraulic hoses or the like. The wireless remote control 190 comprises a standard wireless controller or the like. The Above-Deck mounting bracket 140 comprises metal, steel, aluminum, metal alloy, wood, plastic, fiberglass, ceramic, composite material, or the like. The Above-Deck mounting bolts 145 comprise metal, steel, aluminum, metal alloy, plastic, fiberglass, ceramic, composite material, or the like. The middle mounting bracket 159 comprises metal, steel, aluminum, metal alloy, plastic, fiberglass, ceramic, composite material, or the like. The support arm sleeve 155 comprises metal, steel, aluminum, metal alloy, plastic, fiberglass, ceramic, composite material, or the like. The sleeve bolts 156 comprise metal, steel, aluminum, metal alloy, plastic, fiberglass, ceramic, composite material, or the like. The support arm 150 comprises metal, steel, aluminum, metal alloy, wood, plastic, fiberglass, ceramic, composite material, or the like. The Above-Deck hydraulic cylinder 105 and hydraulic ram 115 comprise a standard hydraulic cylinder and ram or the like. The cap comprises metal, steel, aluminum, metal alloy, wood, plastic, fiberglass, ceramic, composite material, or the like. The upper guide post 121 comprises metal, steel, aluminum, metal alloy, wood, plastic, fiberglass, ceramic, composite material, or the like. The lower guide post 123 comprises metal, steel, aluminum, metal alloy, wood, plastic, fiberglass, ceramic, composite material, or the like. The hydraulic base 130 comprises metal, steel, aluminum, metal alloy, plastic, fiberglass, ceramic, composite material, or the like. The platform base 135 comprises metal, steel, aluminum, metal alloy, plastic, fiberglass, ceramic, composite material, or the like. The ram bolt 137 comprises metal, steel, aluminum, metal alloy, plastic, fiberglass, ceramic, composite material, or the like. The platform arm 117 comprises metal, steel, aluminum, metal alloy, plastic, fiberglass, ceramic, composite material, or the like. The arm bolt 138 comprises metal, steel, aluminum, metal alloy, plastic, fiberglass, ceramic, composite material, or the like. The hinge knuckle 127 comprises metal, steel, aluminum, metal alloy, plastic, fiberglass, ceramic, composite material, or the like. The Above-Deck stand platform 110 comprises metal, steel, aluminum, metal alloy, wood, plastic, fiberglass, ceramic, composite material, or the like. The hinge pin 122 comprises metal, steel, aluminum, metal alloy, plastic, fiberglass, ceramic, composite material, or the like. The materials listed herein are examples only and not intended to limit the scope of the present invention.

Figure 20:
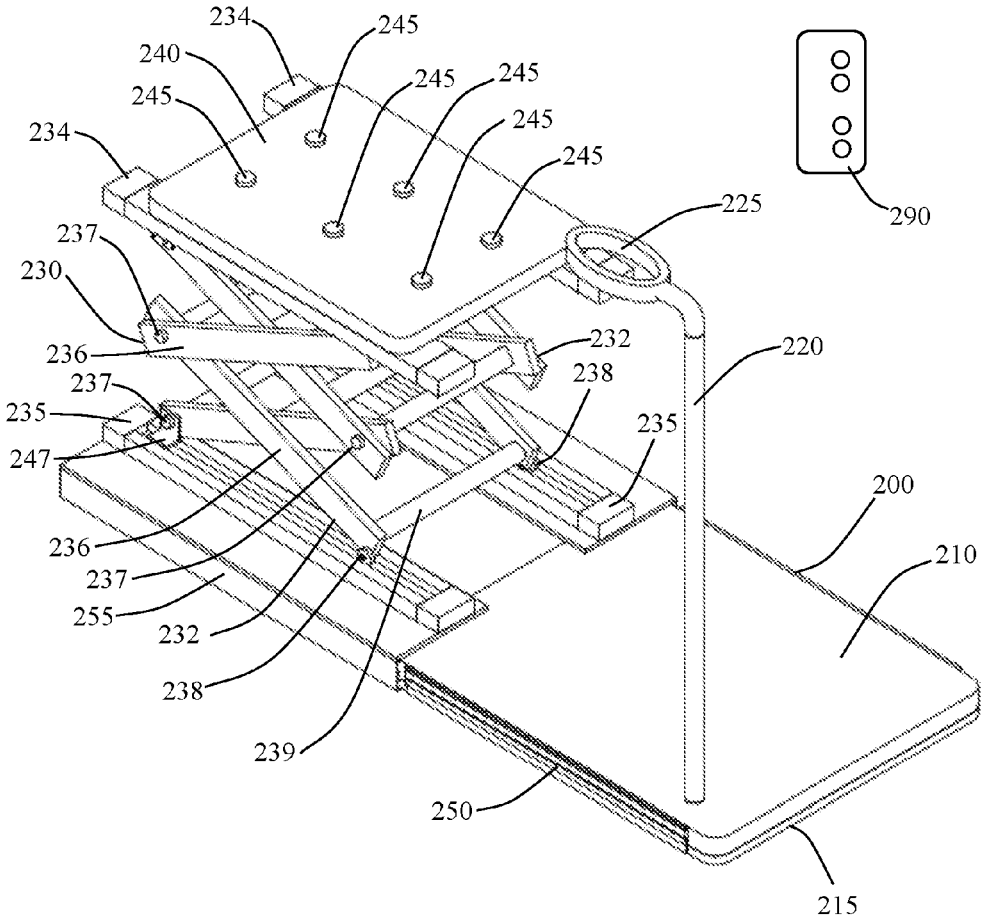
FIG. 20 is a front perspective view of another preferred embodiment of an apparatus of the present invention.
Figure 21:
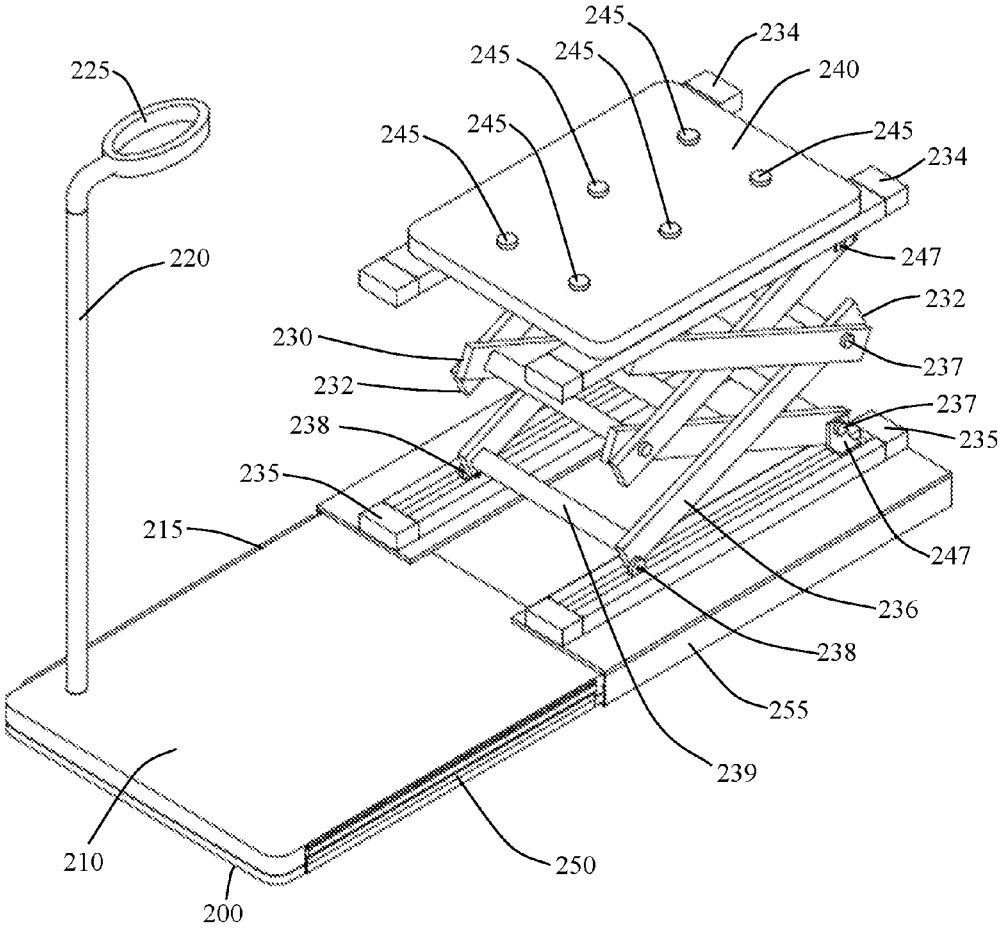
FIG. 21 is a rear perspective view of an apparatus of FIG. 20.
Figure 22:
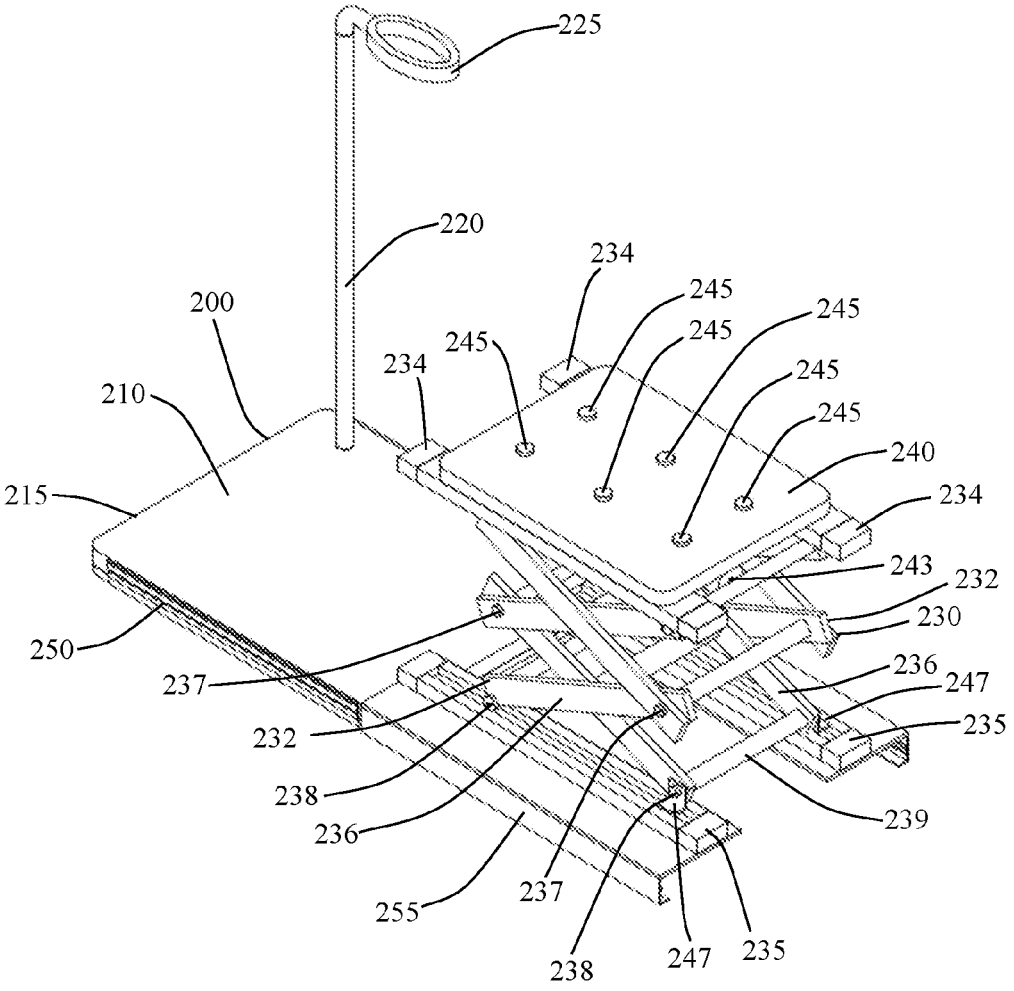
FIG. 22 is a right side perspective view of an apparatus of FIG. 20.
Figure 23:
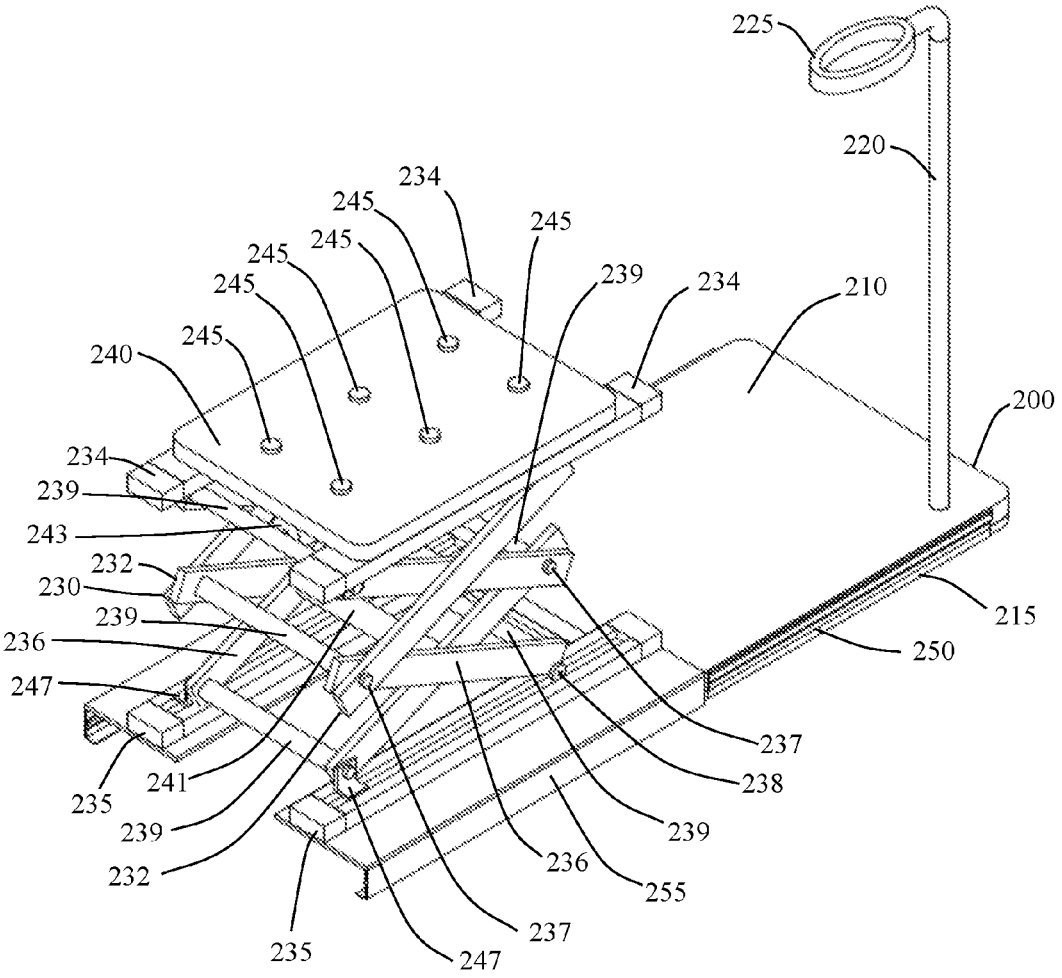
FIG. 23 is a left side perspective view of an apparatus of FIG. 20.
Figure 24:
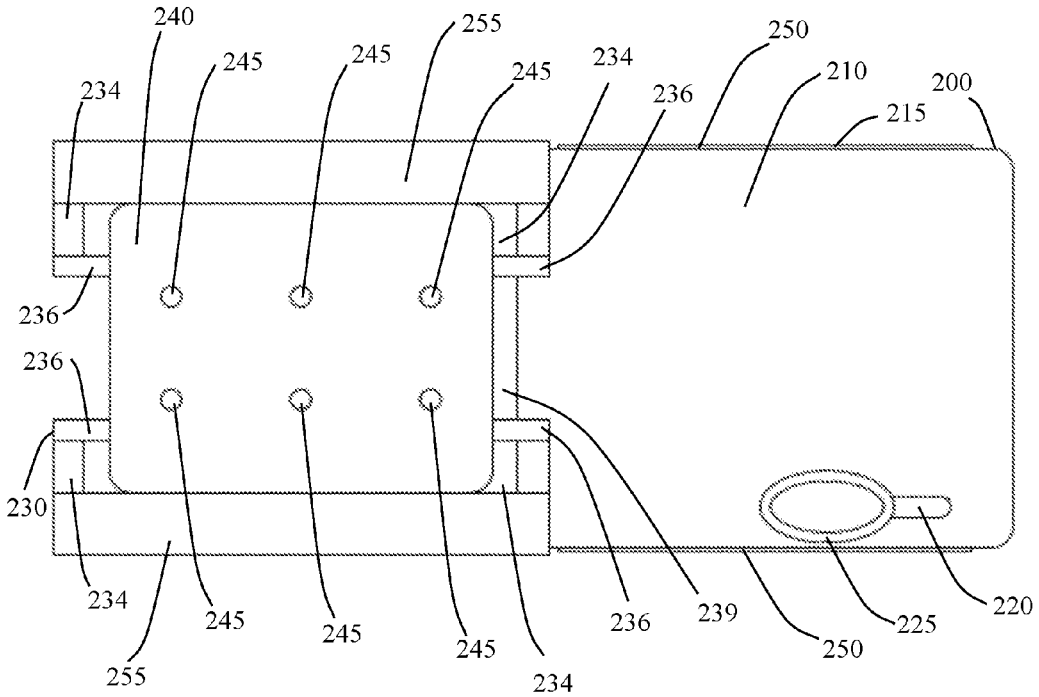
FIG. 24 is a top view of an apparatus of FIG. 20.
Figure 25:
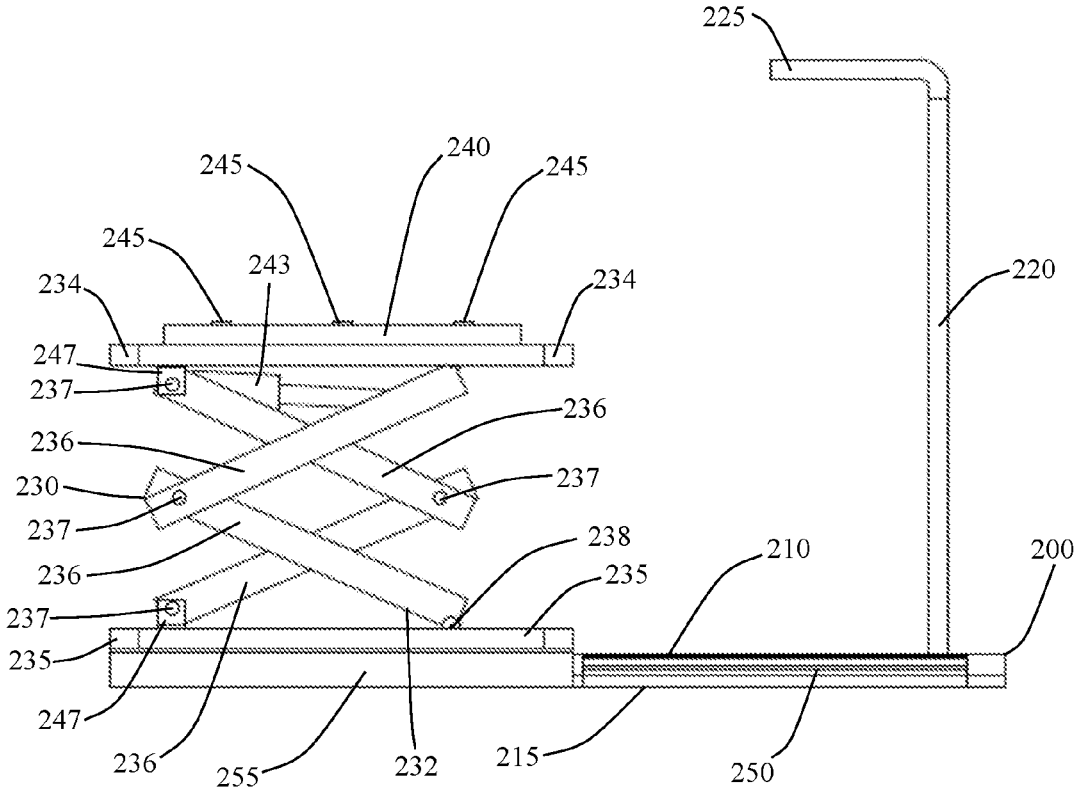
FIG. 25 is a front view of an apparatus of FIG. 20.
Figure 26:
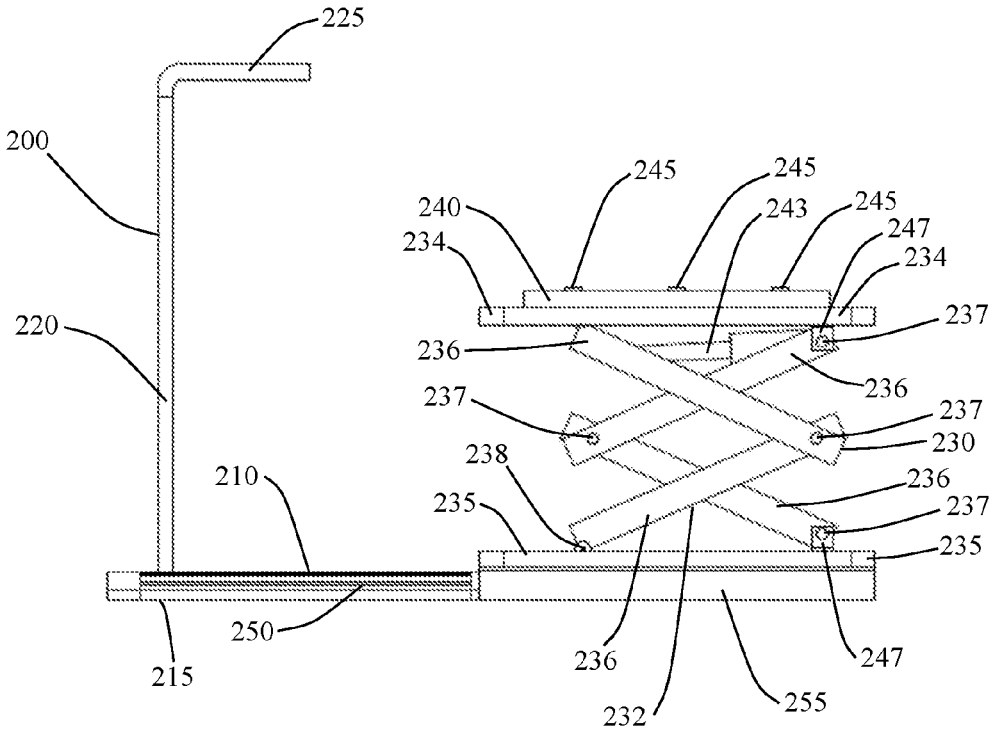
FIG. 26 is a rear view of an apparatus of FIG. 20.
Figure 27:
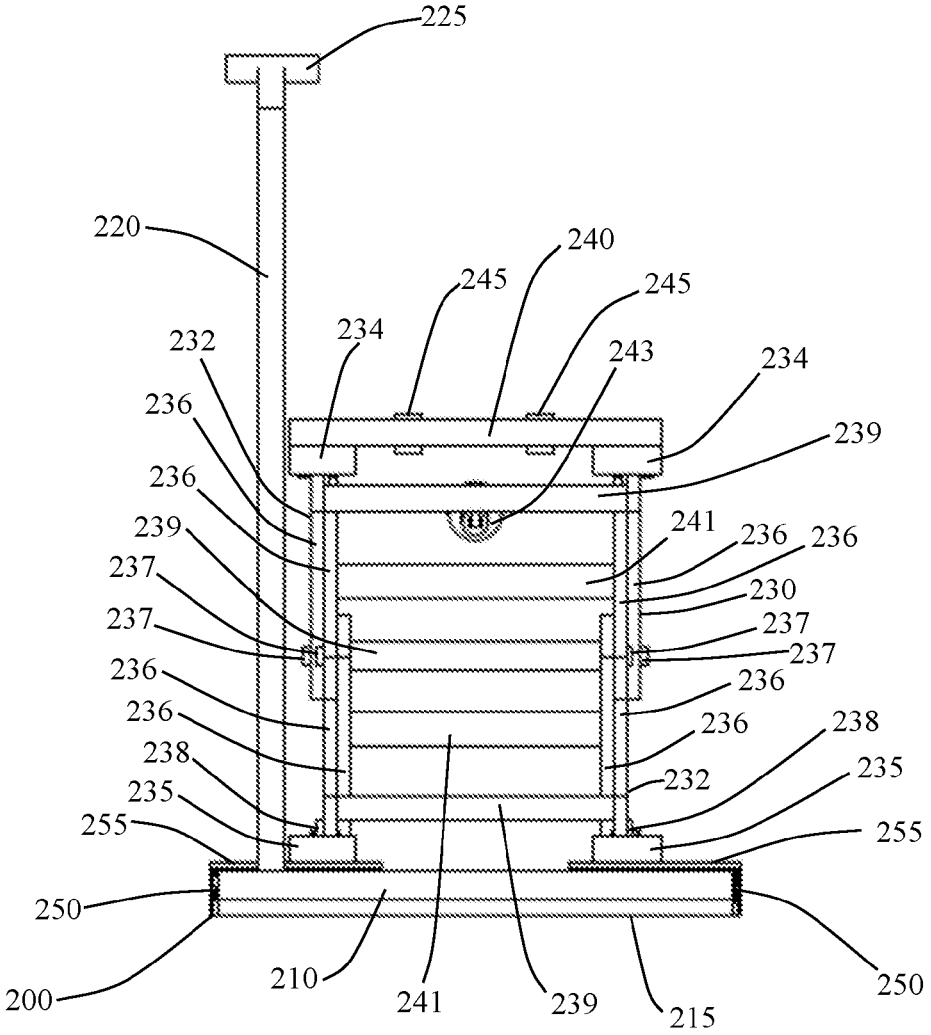
FIG. 27 is a right side view of an apparatus of FIG. 20.
Figure 28:
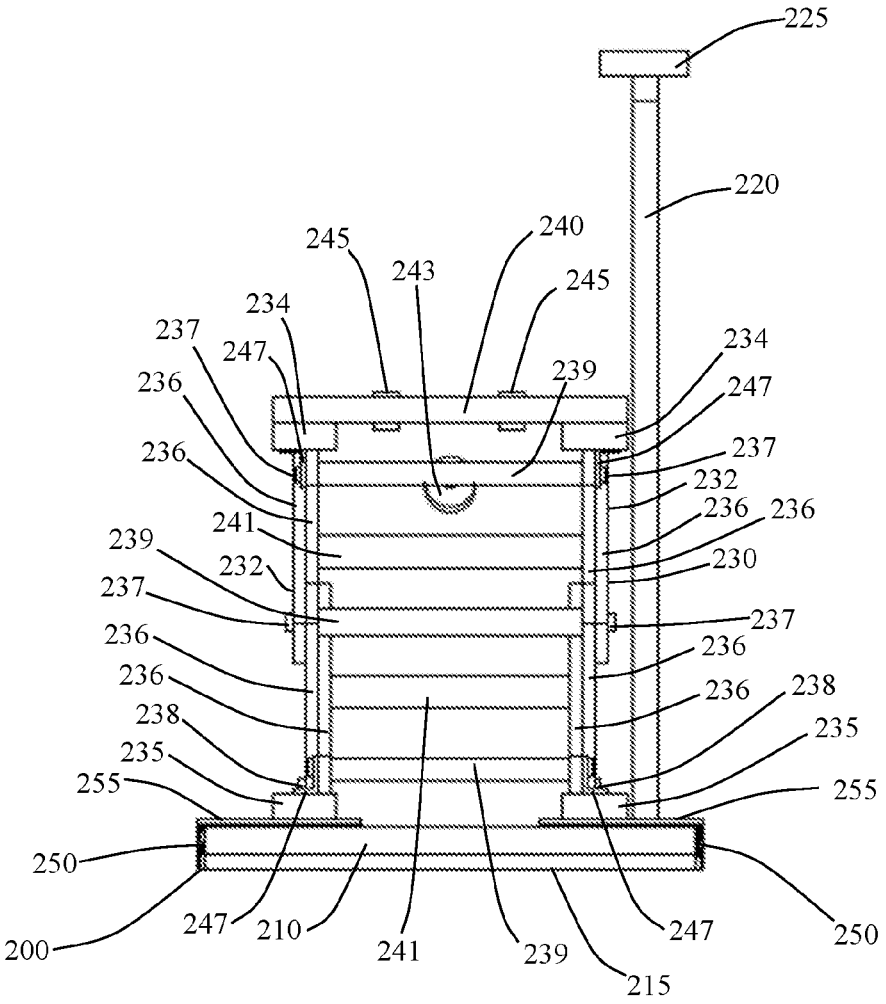
FIG. 28 is a left side view of an apparatus of FIG. 20.
Figure 29:
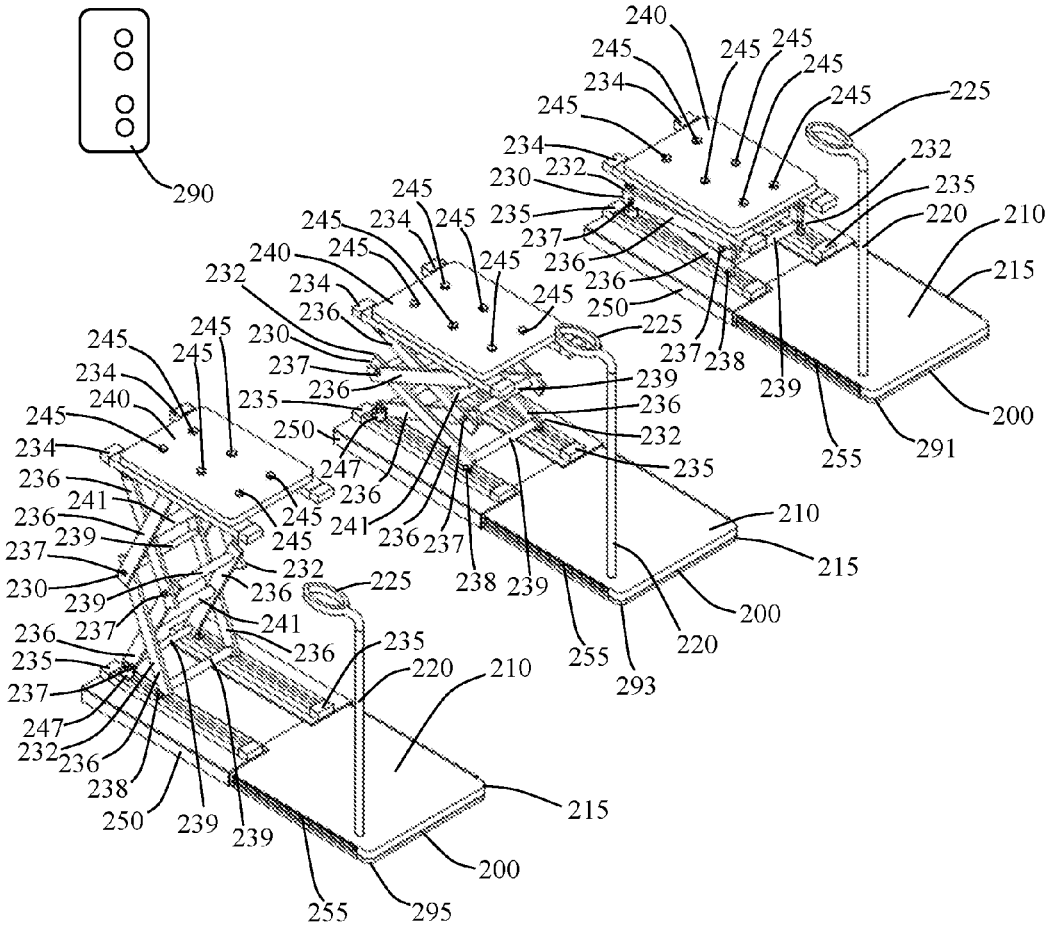
FIG. 29 is a set of front perspective views showing an apparatus of FIG. 20 in an upper position, a middle position, and a lower position.
Figure 30:
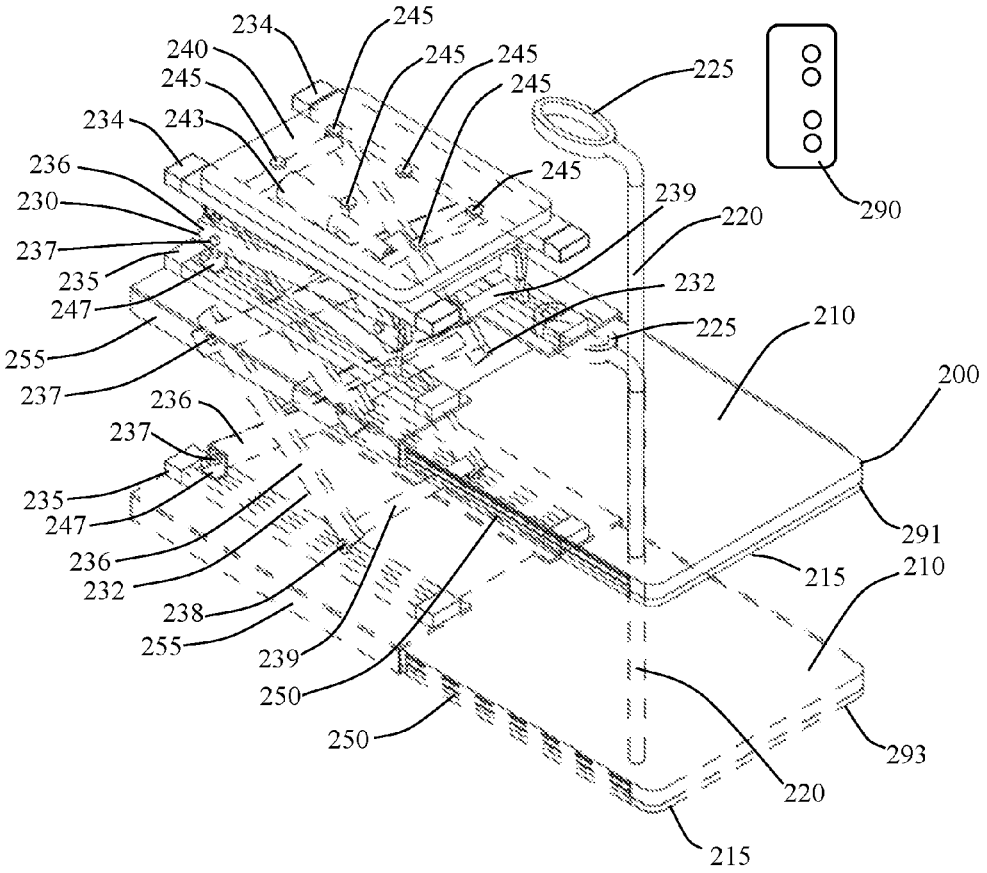
FIG. 30 is a front perspective view of an apparatus of FIG. 20 in an upper position and shows a middle position overlaid in dotted lines.
Figure 31:
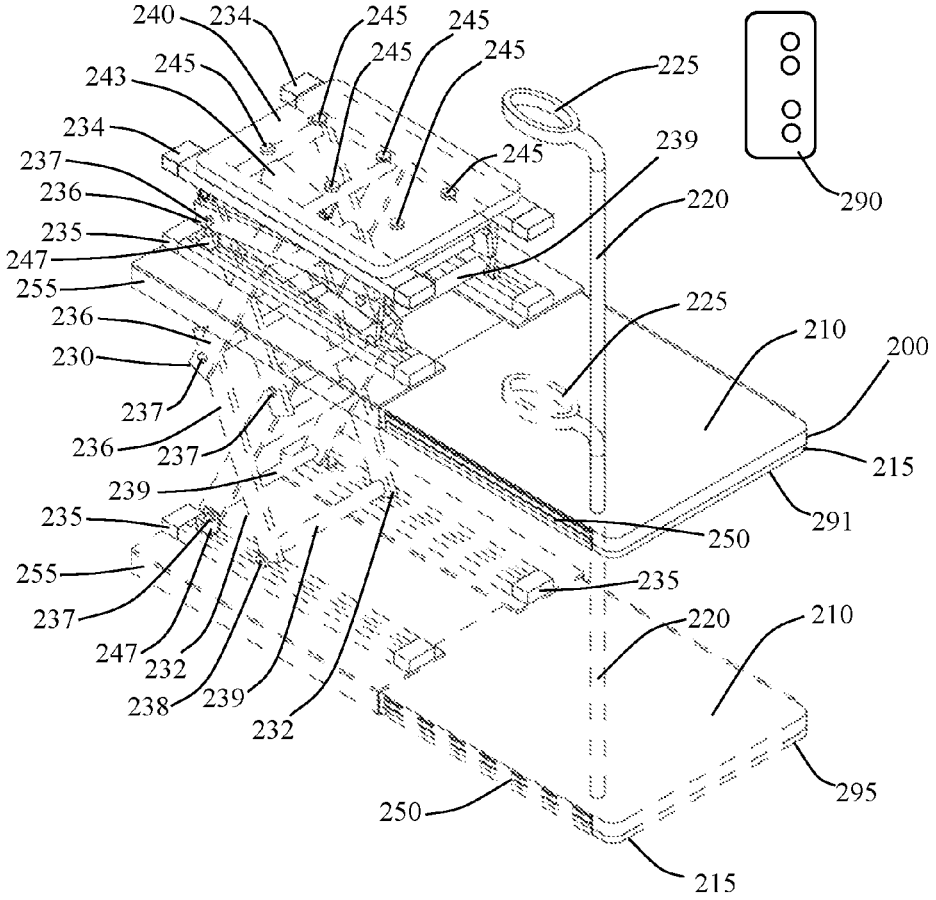
FIG. 31 is a front perspective view of an apparatus of FIG. 20 in an upper position and shows a lower position overlaid in dotted lines.
Figure 32:
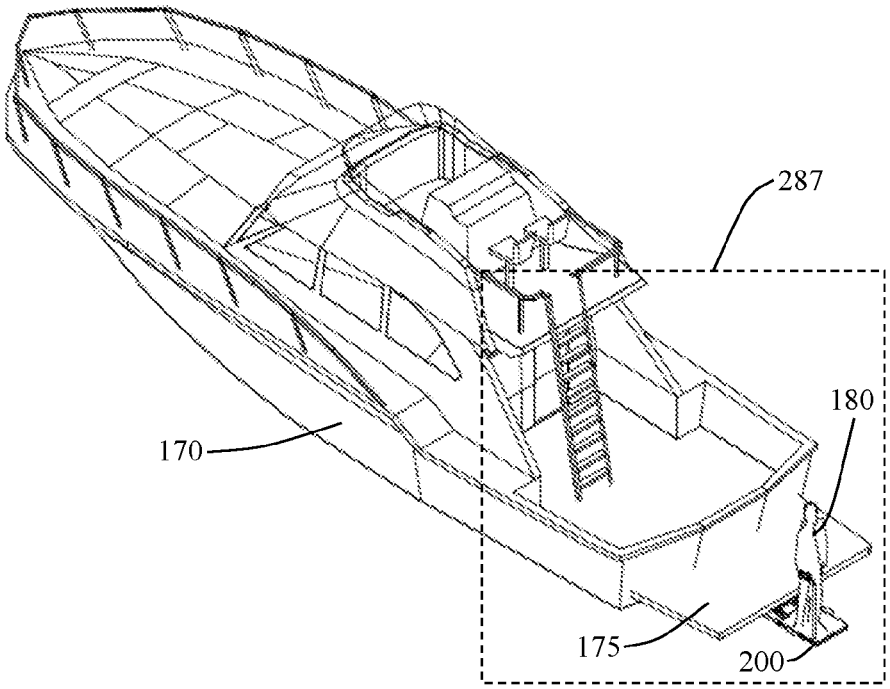
FIG. 32 is a perspective view of an apparatus of FIG. 20 mounted under the swim deck of a boat and shows a user.
Figure 33:
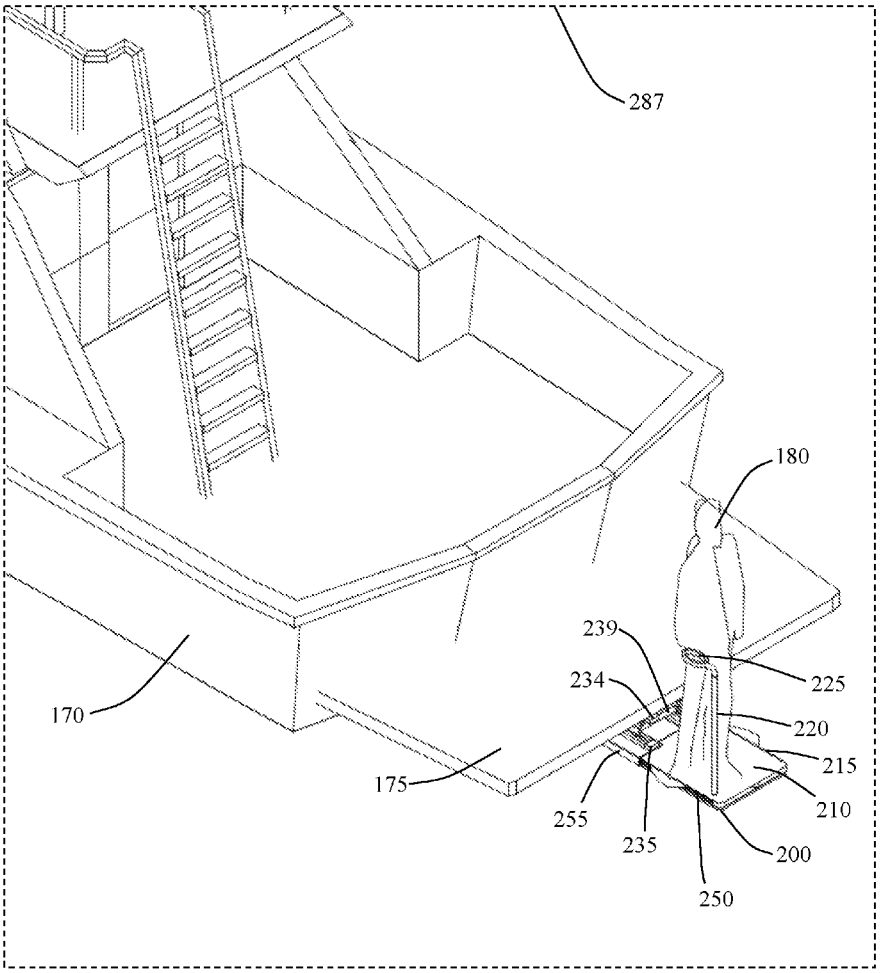
FIG. 33 is a close-up perspective view of an apparatus of FIG. 32 mounted under the swim deck of a boat and shows a user standing on the apparatus.
Figure 34:
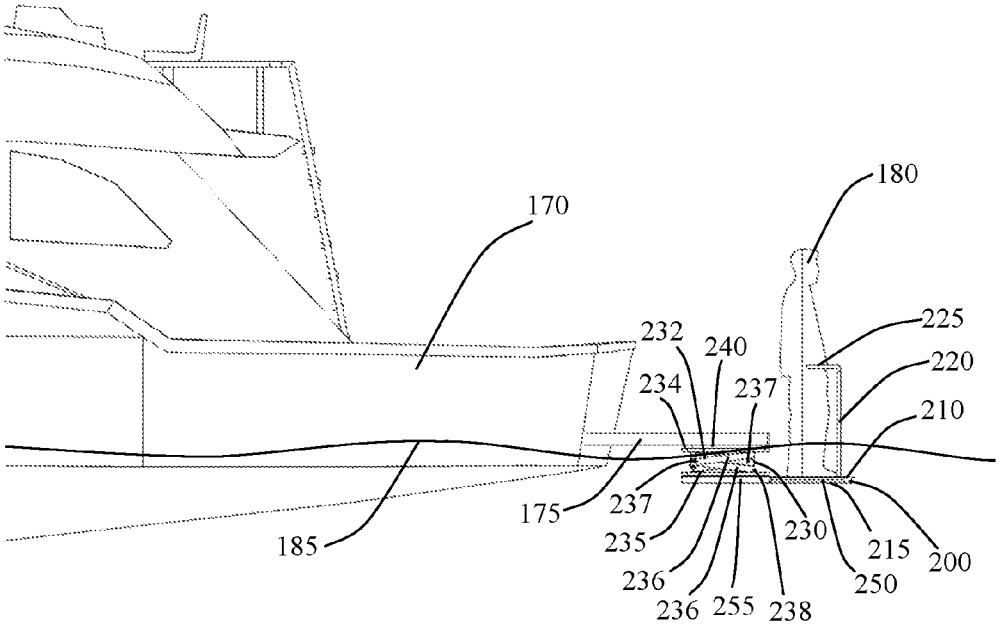
FIG. 34 is a side view of an apparatus of FIG. 20 mounted under the swim deck of a boat and shows a user standing on the apparatus.
Figure 35:
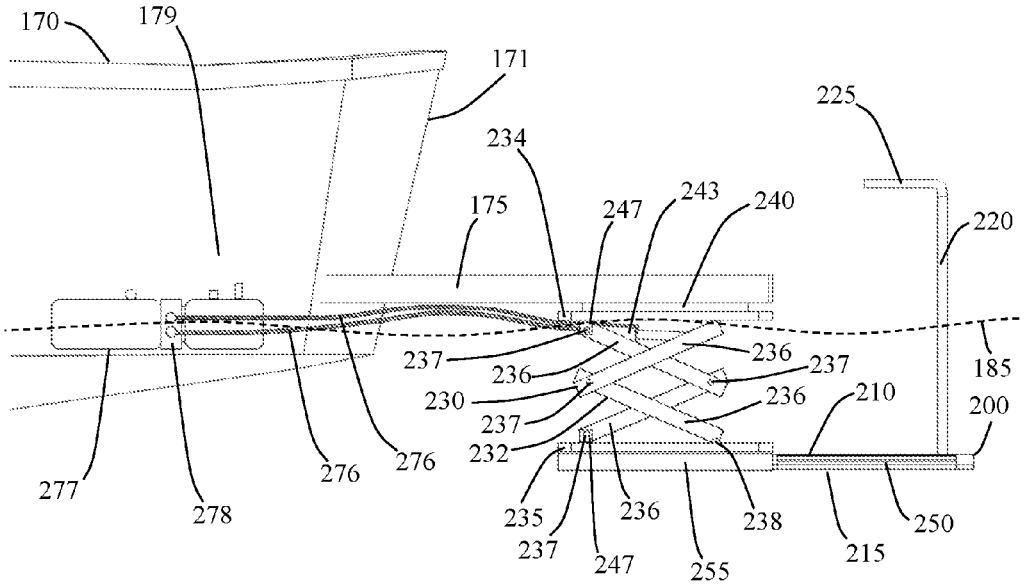
FIG. 35 is a side cutaway view of an apparatus of FIG. 20 mounted under the swim deck of a boat, which shows a hydraulic power unit mounted inside the boat.
Figure 36:
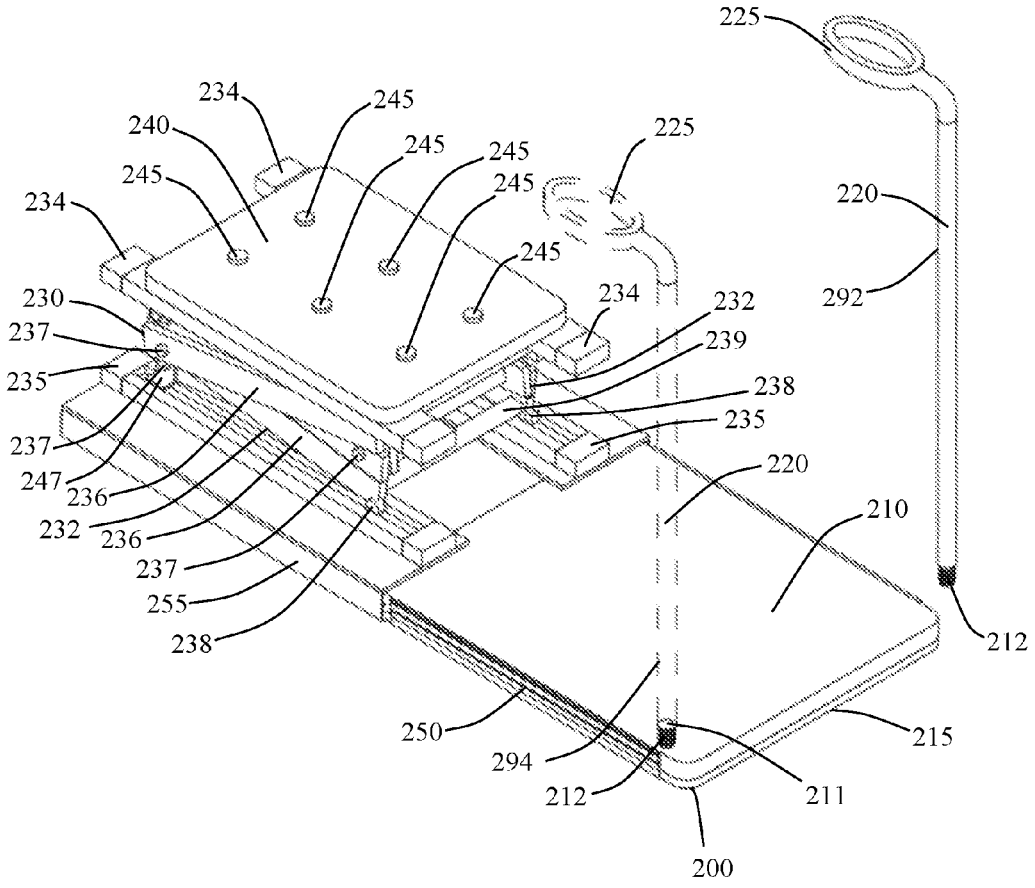
FIG. 36 is a front perspective view of an apparatus of FIG. 20 in the process of attaining a stowed position and shows the handle being removed.
Figure 37:
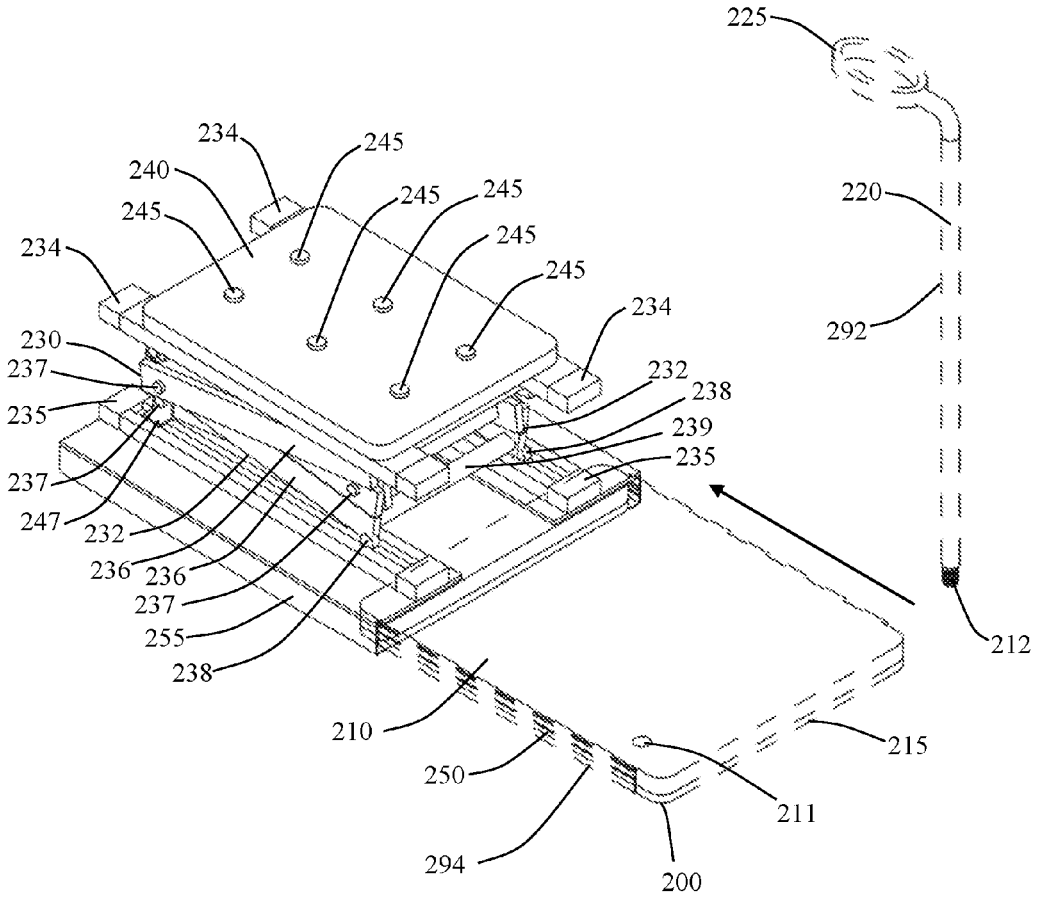
FIG. 37 is a front perspective view of an apparatus of FIG. 20 in the process of attaining a stowed position.
Figure 38:
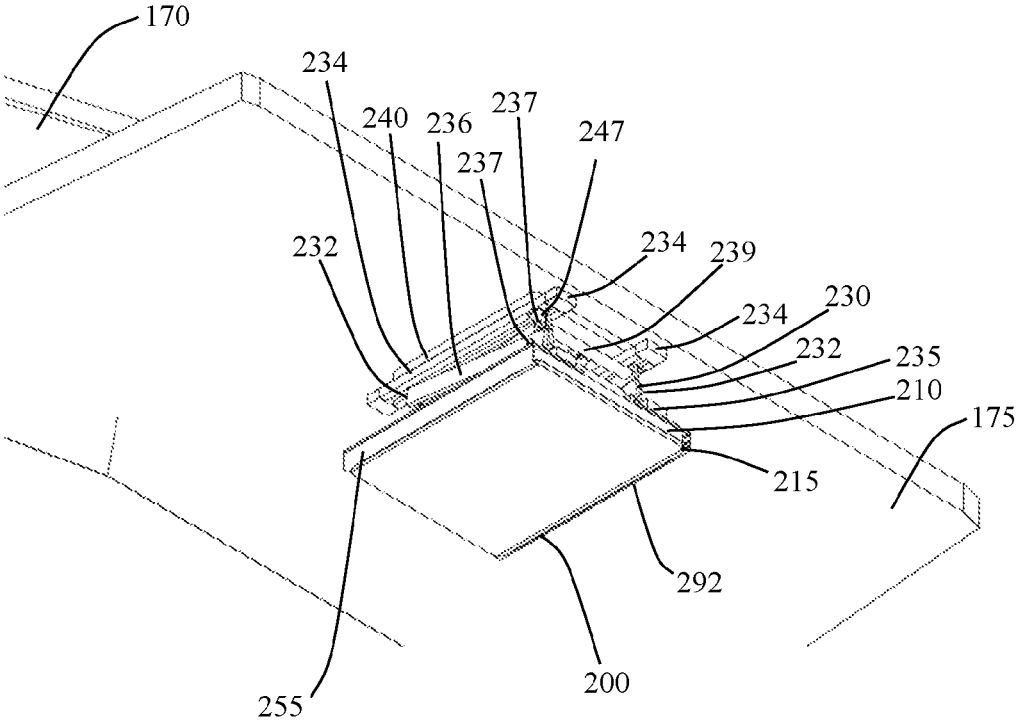
FIG. 38 is a perspective view of an apparatus of FIG. 20 mounted under the swim deck of a boat and in a stowed position.
Figure 39:
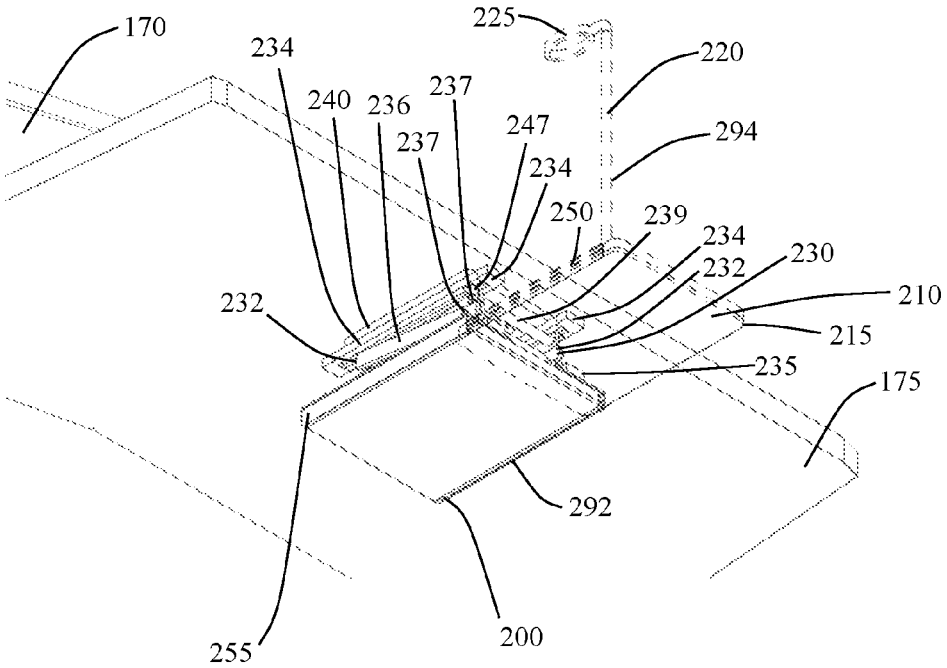
FIG. 39 is a perspective view of an apparatus of FIG. 20 mounted under the swim deck of a boat and in a stowed position with a deployed position overlaid in dotted lines.

Referring now to another preferred embodiment of the present invention, in FIG. 20, FIG. 21, FIG. 22, FIG. 23, FIG. 24, FIG. 25, FIG. 26, FIG. 27, FIG. 28, FIG. 29, FIG. 30, FIG. 31, FIG. 32, FIG. 33, FIG. 34, FIG. 35, FIG. 36, FIG. 37, FIG. 38 and FIG. 39, a Scissor-Jack Swim Lift 200 is shown. FIG. 20 illustrates a front perspective view of a Scissor-Jack Swim Lift 100 with a Scissor-Jack wireless remote 290. FIG. 21 depicts a rear perspective view of a Scissor-Jack Swim Lift 200. FIG. 22 shows a right side perspective view of a Scissor-Jack Swim Lift 200. FIG. 23 displays a left side perspective view of a Scissor-Jack Swim Lift 200. FIG. 24 shows a top view of a Scissor-Jack Swim Lift 200. FIG. 25 depicts a front view of a Scissor-Jack Swim Lift 200. FIG. 26 illustrates a rear view of a Scissor-Jack Swim Lift 200. FIG. 27 demonstrates a right side view of a Scissor-Jack Swim Lift 200. FIG. 28 shows a left side view of a Scissor-Jack Swim Lift 200. FIG. 29 displays a set of front perspective views showing a Scissor-Jack Swim Lift 200 in a Scissor-Jack upper position 291, a Scissor-Jack middle position 293, and a Scissor-Jack lower position 295, and showing a Scissor-Jack wireless remote 290. FIG. 30 depicts a front perspective view of a Scissor-Jack Swim Lift 200 in a Scissor-Jack upper position 291, shows a Scissor-Jack middle position 293 overlaid in dotted lines, and shows a Scissor-Jack wireless remote 290. FIG. 31 demonstrates a front perspective view of a Scissor-Jack Swim Lift 200 in a Scissor-Jack upper position 291, shows a Scissor-Jack lower position 295 overlaid in dotted lines, and shows a Scissor-Jack wireless remote 290. FIG. 32 displays a perspective view of a Scissor-Jack Swim Lift 200 mounted under the swim deck 175 of a boat 170 and showing a user 180. FIG. 33 illustrates a close-up perspective view of the Scissor-Jack close-up box 287 of FIG. 32, showing a Scissor-Jack Swim Lift 200 mounted under the swim deck 175 of a boat 170 and showing a user 180 standing on the Scissor-Jack stand platform 210 of a Scissor-Jack Swim Lift 200. FIG. 34 depicts a side view of a Scissor-Jack Swim Lift 200 mounted under the swim deck 175 of a boat 170 and showing a user 180 standing on the Scissor-Jack stand platform 210 of a Scissor-Jack Swim Lift 200 and indicating a water line 185. FIG. 35 shows a side cutaway view of a Scissor-Jack Swim Lift 200 mounted on the swim deck 175 of a boat 170, which shows a Scissor-Jack hydraulic power unit 277 mounted inside the boat 170 in a closed compartment 179 behind the rear transom of the boat 170 and which indicates a water line 185. FIG. 36 depicts a front perspective view of a Scissor-Jack Swim Lift 200 in the process of attaining a Scissor-Jack stowed configuration 292 with a Scissor-Jack handle 220 shown removed in the Scissor-Jack stowed configuration 292 and displayed in solid lines and the Scissor-Jack handle 220 shown in the Scissor-Jack deployed configuration 294 overlaid in dotted lines. FIG. 37 displays a front perspective view of an Scissor-Jack Swim Lift 200 in the process of attaining an Scissor-Jack stowed configuration 292 with a Scissor-Jack handle 220 in the stowed configuration 292, which is removed, and displayed in dotted lines; a Scissor-Jack stand platform 210 displayed in the Scissor-Jack deployed configuration 294 in dotted lines; and the Scissor-Jack Swim Lift 200 shown in the Scissor-Jack stowed configuration 292 and displayed in solid lines. FIG. 38 illustrates a perspective view of a Scissor-Jack Swim Lift 200 mounted under a swim deck 175 of a boat 170 and in the Scissor-Jack stowed configuration 292. FIG. 39. shows a perspective view of a Scissor-Jack Swim Lift 200 mounted under a swim deck 175 of a boat 170 with the Scissor-Jack stowed configuration 292 displayed in solid lines and the Scissor-Jack deployed configuration 294 overlaid in dotted lines.

Referring still to the preferred embodiment of the invention in FIG. 20, FIG. 21, FIG. 22, FIG. 23, FIG. 24, FIG. 25, FIG. 26, FIG. 27, FIG. 28, FIG. 29, FIG. 30, FIG. 31, FIG. 32, FIG. 33, FIG. 34, FIG. 35, FIG. 36, FIG. 37, FIG. 38 and FIG. 39, the Scissor-Jack Swim Lift 200 comprises a Scissor-Jack mounting bracket 240, which attaches to the underside of the swim deck 175 of the boat 170 using a plurality of Scissor-Jack mounting bolts 245; a Scissor-Jack lift assembly 230, which is connected to the Scissor-Jack mounting bracket 240; and a Scissor-Jack stand assembly 215, which is attached to the Scissor-Jack lift assembly 230; a Scissor-Jack hydraulic power unit 277, which is situated inside a closed compartment 179 behind the rear transom of the boat 170 and is connected to the boat's 12-volt battery system 172; Scissor-Jack hydraulic hoses 276 that run from the Scissor-Jack hydraulic power unit 277 and through the hull 171 of a boat 170 to the Scissor-Jack lift assembly 230; and an Scissor-Jack wireless remote control 290, which operates the Scissor-Jack hydraulic power unit 277. The Scissor-Jack lift assembly 230 further comprises two parallel upper slider rails 234, which are connected to the Scissor-Jack mounting bracket 240; two parallel lower slider rails 235, which are connected to the Scissor-Jack stand assembly; two parallel scissor extenders 232, which are slidably connected to the upper slider rails 234 and the lower slider rails 235 using slider connectors 238, which are pivotally connected to the upper slider rail 234 and lower slider rail 235 using pivot connectors 247, and which are connected to each other by outer cross bars 239 and inner cross bars 241; and a Scissor-Jack hydraulic cylinder 243, which is connected to opposing top outer cross bars 239. The scissor extenders 232 further comprise a plurality of diagonally crossing scissor arms 236, which are pivotally connected at their outer ends by scissor bolts 237. The Scissor-Jack stand assembly 215 further comprises a Scissor-Jack stand platform 210, upon which a user 180 may stand, with stand platform slider rails 250; a Scissor-Jack handle bar 225, which detachably depends from the Scissor-Jack stand platform 210; and a stand base 255, which is attached to the lower slider rails 235 and which slidably receives the Scissor-Jack stand platform 210.

In further detail, referring still to FIG. 20, FIG. 21, FIG. 22, FIG. 23, FIG. 24, FIG. 25, FIG. 26, FIG. 27, FIG. 28, FIG. 29, FIG. 30, FIG. 31, FIG. 32, FIG. 33, FIG. 34, FIG. 35, FIG. 36, FIG. 37, FIG. 38 and FIG. 39; in FIG. 29, FIG. 30 and FIG. 31 a sequence of events are depicted, which describe the motion of a Scissor-Jack Swim Lift 200 as it lowers the Scissor-Jack stand platform 210 into the water. First, in the Scissor-Jack upper position 291, the Scissor-Jack hydraulic cylinder 243 is fully extended, and the Scissor-Jack stand platform 210 is at the highest position at substantially the same level of the swim deck 175 of the boat 170, so that a user 180 may easily step from the swim deck 175 to the Scissor-Jack stand platform 210. To initiate the motion of the Scissor-Jack Swim Lift 200, the user 180 uses the Scissor-Jack wireless remote 290 to activate the Scissor-Jack hydraulic power unit 277 and retract the Scissor-Jack hydraulic cylinder 243, thereby shortening the horizontal diagonal of a parallelogram formed by the diagonally crossing scissor arms 236. During transition to the Scissor-Jack lower position 295, the Scissor-Jack Swim Lift 200 reaches a Scissor-Jack middle position 293. In a Scissor-Jack middle position 293, the Scissor-Jack hydraulic cylinder 243 is partially retracted, and the Scissor-Jack stand platform 210 is transitioned deeper into the water. In the Scissor-Jack lower position 295, the Scissor-Jack hydraulic cylinder 243 is fully retracted, and the Scissor-Jack is at its lowest position in the water. For a user 180 to be lifted out of the water, while swimming or in the water a user 180 stands upon the Scissor-Jack stand platform 210 with the Scissor-Jack Swim Lift 200 in the Scissor-Jack lower position 295. The user 180 then uses the Scissor-Jack wireless remote 290 to activate the Scissor-Jack hydraulic power unit 277 and extend it, thereby lengthening the horizontal diagonal of a parallelogram formed by the diagonally crossing scissor arms 236 and thereby lifting the Scissor-Jack stand platform 210 and the user 180 out of the water. Releasing the Scissor-Jack wireless remote 290 at anytime stops the motion of the Scissor-Jack stand platform 210. When the Scissor-Jack Swim Lift 200 reaches the Scissor-Jack upper position 291, the Scissor-Jack hydraulic cylinder 243 is fully extended, and the Scissor-Jack stand platform 210 is at substantially the same level of the swim deck 175 of the boat 170, so that the user 180 may easily step from the Scissor-Jack stand platform 210 to the swim deck 175 of the boat 170.

In further detail, referring still to FIG. 20, FIG. 21, FIG. 22, FIG. 23, FIG. 24, FIG. 25, FIG. 26, FIG. 27, FIG. 28, FIG. 29, FIG. 30, FIG. 31, FIG. 32, FIG. 33, FIG. 34, FIG. 35, FIG. 36, FIG. 37, FIG. 38 and FIG. 39, in FIG. 36, FIG. 37, FIG. 38 and FIG. 39 a sequence of events are depicted, which describe the process of setting an Scissor-Jack Swim Lift 200 into an Scissor-Jack stowed configuration 292. First, while the Scissor-Jack Swim Lift 200 is in a Scissor-Jack deployed configuration 294, the Scissor-Jack handle bar 225 is removed from the Scissor-Jack stand platform 210 by separating the handle bar peg 212 from the handle peg hole 211, as shown in FIG. 36 and FIG. 37. Next, the Scissor-Jack stand platform 210 is received into the stand base 255 by sliding along the stand platform slider rails 250, as shown in FIG. 37. When the Scissor-Jack stand platform 210 is fully received into the stand base 255, the Scissor-Jack Swim Lift 200 is in the Scissor-Jack stowed configuration 292, as shown in FIG. 38.

The construction details of the invention as shown in FIG. 20, FIG. 21, FIG. 22, FIG. 23, FIG. 24, FIG. 25, FIG. 26, FIG. 27, FIG. 28, FIG. 29, FIG. 30, FIG. 31, FIG. 32, FIG. 33, FIG. 34, FIG. 35, FIG. 36, FIG. 37, FIG. 38 and FIG. 39, are as follows. The Scissor-Jack hydraulic power unit 277 comprises a standard hydraulic actuator or the like. The Scissor-Jack hydraulic hoses 276 comprise standard hydraulic hoses or the like. The wireless remote control 290 comprises a standard wireless controller or the like. The Scissor-Jack mounting bracket 240 comprises metal, steel, aluminum, metal alloy, wood, plastic, fiberglass, ceramic, composite material, or the like. The Scissor-Jack mounting bolts 245 comprise metal, steel, aluminum, metal alloy, plastic, fiberglass, ceramic, composite material, or the like. The upper slider rails 234 comprise metal, steel, aluminum, metal alloy, plastic, fiberglass, ceramic, composite material, or the like. The lower slider rails 235 comprise metal, steel, aluminum, metal alloy, plastic, fiberglass, ceramic, composite material, or the like. The slider connectors 238 comprises metal, steel, aluminum, metal alloy, plastic, fiberglass, ceramic, composite material, or the like. The pivot connectors 247 comprises metal, steel, aluminum, metal alloy, plastic, fiberglass, ceramic, composite material, or the like. The outer cross bars 239 comprise metal, steel, aluminum, metal alloy, plastic, fiberglass, ceramic, composite material, or the like. The inner cross bars 241 comprise metal, steel, aluminum, metal alloy, plastic, fiberglass, ceramic, composite material, or the like. The Scissor-Jack hydraulic cylinder 243 comprises a standard hydraulic cylinder and ram, or the like. The scissor arms 236 comprise metal, steel, aluminum, metal alloy, plastic, fiberglass, ceramic, composite material, or the like. The scissor bolts 237 comprise metal, steel, aluminum, metal alloy, plastic, fiberglass, ceramic, composite material, or the like. The Scissor-Jack stand platform 210 comprises metal, steel, aluminum, metal alloy, wood, plastic, fiberglass, ceramic, composite material, or the like. The Scissor-Jack handle bar 225 comprises metal, steel, aluminum, metal alloy, wood, plastic, fiberglass, ceramic, composite material, or the like. The stand base 255 comprises metal, steel, aluminum, metal alloy, wood, plastic, fiberglass, ceramic, composite material, or the like. The stand platform slider rails 250 comprise metal, steel, aluminum, metal alloy, plastic, fiberglass, ceramic, composite material, or the like. The materials listed herein are examples only and not intended to limit the scope of the present invention.

The advantages of the present invention include, without limitation, that it provides a means of easily lifting a single swimmer out of the water and up to the deck of a boat. Further, because the stand platforms of each embodiment are intended to lift a single standing swimmer, the Swim Lift Invention has a compact profile, which does not substantially interfere with the performance and functionality of a boat upon which it is mounted, and allows the device to be easily stored when not in use. Additionally, the Above-Deck Swim Lift 100 embodiment does not extend substantially below the surface of the water when retracted and allow the boat to be used in shallow water while one of these versions is mounted. In sum, the Swim Lift Invention provides convenient means for a swimmer to easily transition between the water and the deck of a boat.

In broad embodiment, the present invention relates generally to a swim lift apparatus, which mounts under the swim deck of a boat and hydraulically actuates a platform that lifts a standing swimmer out of the water and up to the level of the swim deck of a boat and which may be stowed under the swim deck of the boat when not in use.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiments, methods, and examples, but by all embodiments and methods that are within the scope and spirit of the invention as claimed.

What is claimed is:

1. An apparatus for lifting a swimmer to and from a boat, said boat comprising
- a hull,
- a swim deck,
- a battery system,
- a rear transom, and
- a closed compartment behind said rear transom,
- said apparatus comprising:
  - a hydraulic cylinder that extends substantially above said swim deck of said boat, said hydraulic cylinder comprising
    - a hydraulic ram that extends and retracts from said hydraulic cylinder using hydraulic pressure,
  - a mounting bracket that connects to the underside of said swim deck,
  - an anchor assembly that is attached to said hydraulic cylinder and to said mounting bracket,
  - a stand platform attached to said hydraulic ram of said hydraulic cylinder,
  - a guide and hand support that extends upward from said stand platform parallel to said hydraulic cylinder,
  - a hydraulic power unit that is situated inside said closed compartment behind said rear transom of said boat and is connected to said battery system of said boat, said hydraulic power unit being capable of controlling said hydraulic cylinder,
  - hydraulic hoses that run from said hydraulic power unit and through said transom or said hull of said boat to said hydraulic cylinder, and
  - a wireless remote control that operates the hydraulic power unit and said hydraulic cylinder;
  - wherein said swimmer in said boat is lowered into the water around said boat by standing on said stand platform, holding said guide and hand support, and activating said hydraulic cylinder using said wireless remote control, thereby causing said hydraulic ram to extend out of said hydraulic cylinder and lowering said swimmer into said water; and
  - wherein said swimmer in said water around said boat is lifted out of said water by standing on said stand platform, holding said guide and hand support, and activating said hydraulic cylinder using said wireless remote control, thereby causing said hydraulic ram to retract into said hydraulic cylinder and lifting said swimmer out of said water.

2. An apparatus of claim 1, said guide and hand support of said apparatus further comprising
- an upper guide post and
- a lower guide post;
- wherein said lower guide post telescopically extends from said upper guide post with the extension of said hydraulic ram.

3. An apparatus for lifting a swimmer to and from a boat, said boat comprising
- a hull,
- a swim deck,
- a battery system,
- a rear transom, and
- a closed compartment behind said rear transom,
- said apparatus comprising:
  - a hydraulic cylinder capable of extending substantially above said swim deck of said boat, said hydraulic cylinder comprising
    - a hydraulic ram that extends and retracts from said hydraulic cylinder using hydraulic pressure,
  - a mounting bracket that connects to the underside of said swim deck,
  - an anchor assembly, said anchor assembly comprising
    - an anchor base that is attached to said hydraulic cylinder,
    - a middle mounting bracket that is attached to said mounting bracket,
    - a support arm sleeve that is attached to said middle mounting bracket, and
    - a rotatable support arm that extends and retracts from said support arm sleeve and is attached to said anchor base,
  - a stand platform assembly attached to said hydraulic ram of said hydraulic cylinder, said stand platform assembly comprising
    - a stand platform,
    - a stand platform base, and
    - a foldable hinge that hingedly connects said stand platform to said stand platform base, a guide and hand support that extends upward from said stand platform base parallel to said hydraulic cylinder, a hydraulic power unit that is situated inside said closed compartment behind said rear transom of said boat and is connected to said battery system of said boat, said hydraulic power unit being capable of controlling said hydraulic cylinder, hydraulic hoses that run from said hydraulic power unit and through said transom or said hull of said boat to said hydraulic cylinder, and a wireless remote control that operates said hydraulic power unit and said hydraulic cylinder;

wherein said swimmer in said boat is lowered into the water around said boat by standing on said stand platform, holding said guide and hand support, and activating said hydraulic cylinder using said wireless remote control, thereby causing said hydraulic ram to extend out of said hydraulic cylinder and lowering said swimmer into said water;

wherein said swimmer in said water around said boat is lifted out of said water by standing on said stand platform, holding said guide and hand support, and activating said hydraulic cylinder using said wireless remote control, thereby causing said hydraulic ram to retract into said hydraulic cylinder and lifting said swimmer out of said water; and wherein said apparatus is set into a stowed configuration by folding said stand platform to be parallel to said hydraulic cylinder; rotating said rotatable support arm along with said anchor base, folded said stand platform, said guide and hand support, and said hydraulic cylinder, 90 degrees; and retracting said rotatable support arm into said support arm sleeve so that said apparatus is stowed beneath said swim deck.

4. An apparatus of claim 2, said guide and hand support of said apparatus further comprising an upper guide post and a lower guide post;

wherein said lower guide post telescopically extends from said upper guide post with the extension of said hydraulic ram.

5. An apparatus for lifting a swimmer to and from a boat, said boat comprising a hull, a swim deck, a battery system, a rear transom, and a closed compartment behind said rear transom, said apparatus comprising:

a mounting bracket that connects to the underside of said swim deck, a scissor mechanism that is attached to said mounting bracket, said scissor mechanism comprising two parallel scissor extenders, said scissor extenders being capable of extending and retracting, each said scissor extender comprising a plurality of diagonally crossing scissor arms, an upper slide rail, said upper slide rail being attached to said mounting bracket, and a lower slide rail, a plurality of cross bars connecting said scissor extenders, a hydraulic cylinder that extends and retracts said scissor extenders, a base assembly, said base assembly comprising a stand base, said lower side rails of said scissor mechanism being attached to said stand base, said stand base comprising an inner storage chamber, a stand platform, said stand platform being capable of extending from retracting into said inner storage chamber of said stand base and under said swim deck of said boat for storage when not in use, a detachable handle bar, said detachable handle bar distending from said retracting stand platform in a removable fashion, a hydraulic power unit that is situated inside said closed compartment behind said rear transom of said boat and is connected to said battery system of said boat, said hydraulic power unit being capable of controlling said hydraulic cylinder, hydraulic hoses that run from said hydraulic power unit and through said transom or said hull of said boat to said hydraulic cylinder, and a wireless remote control that operates said hydraulic power unit and said hydraulic cylinder;

wherein said swimmer in said boat is lowered into the water around said boat by standing on said stand platform, holding said detachable handle bar and activating said hydraulic cylinder using said wireless remote control, thereby causing said scissor extenders to extend downward and lowering said swimmer into said water;

wherein said swimmer in said water around said boat is lifted out of said water by standing on said stand platform, holding said detachable handle bar, and activating said hydraulic cylinder using said wireless remote control, thereby causing said scissor extenders to retract upward and lifting said swimmer out of said water; and wherein said apparatus is set into a stowed configuration by fully retracting said scissor extenders, removing said detachable handle bar from said stand platform, and retracting said stand platform into said inner storage chamber of said stand base so that said apparatus is stowed beneath said swim deck.

* * * * *